US008789612B2

(12) United States Patent
Haeberle et al.

(10) Patent No.: US 8,789,612 B2
(45) Date of Patent: Jul. 29, 2014

(54) OPEN-HOLE PACKER FOR ALTERNATE PATH GRAVEL PACKING, AND METHOD FOR COMPLETING AN OPEN-HOLE WELLBORE

(75) Inventors: David C. Haeberle, Cypress, TX (US); Michael D. Barry, The Woodlands, TX (US); Michael T. Hecker, Tomball, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 257 days.

(21) Appl. No.: 13/500,549

(22) PCT Filed: Aug. 23, 2010

(86) PCT No.: PCT/US2010/046329

§ 371 (c)(1),
(2), (4) Date: Apr. 5, 2012

(87) PCT Pub. No.: WO2011/062669

PCT Pub. Date: May 26, 2011

(65) Prior Publication Data

US 2012/0217010 A1 Aug. 30, 2012

Related U.S. Application Data

(60) Provisional application No. 61/263,120, filed on Nov. 20, 2009.

(51) Int. Cl.

| | |
|---|---|
| ***E21B 43/04*** | (2006.01) |
| ***E21B 33/124*** | (2006.01) |
| ***E21B 33/10*** | (2006.01) |

(52) U.S. Cl.

CPC ..... *E21B 33/10* (2013.01); *E21B 43/04* (2013.01)

USPC ..... 166/387; 166/191; 166/179; 166/278

(58) Field of Classification Search

CPC ..... E21B 33/10; E21B 43/04

USPC ..... 166/387, 191, 179, 278

See application file for complete search history.

(56) References Cited

U.S. PATENT DOCUMENTS 4,945,991 A 8/1990 Jones
5,082,052 A 1/1992 Jones et al.

(Continued)

FOREIGN PATENT DOCUMENTS

WO WO 2007/031723 A2 3/2007

OTHER PUBLICATIONS

Barry, M. D. et al., Ópenhole Gravel Packing With Zonal Isolation, SPE 110460, Nov. 11-14, 2007, 2007 SPE Annual Technical Conference, pp. 1-10, Anaheim, CA.

(Continued)

*Primary Examiner* — Kenneth L Thompson

(74) *Attorney, Agent, or Firm* — ExxonMobil Upstream Research Company - Law Department

(57) ABSTRACT

Zonal isolation apparatus includes at least one packer assembly and can be used in completing an open-hole portion of a wellbore, which open-hole portion extends through at least two subsurface intervals. The zonal isolation apparatus includes base pipe and filter medium, which together form a sand screen. Each packer assembly comprises at least two mechanically set packer elements. Intermediate the at least two mechanically set packer elements is at least one swellable packer element. The swellable packer element is actuated over time in the presence of a fluid such as water, oil, or a chemical. Swelling may occur should one of the mechanically set packer elements fail. The zonal isolation apparatus also includes alternate flow channel(s) that serve to divert gravel pack slurry from an upper interval to lower intervals during gravel packing operations. A method for completing a wellbore using the zonal isolation apparatus is also provided herein.

32 Claims, 13 Drawing Sheets

(56) References Cited

U.S. PATENT DOCUMENTS

| | | | |
|---|---|---|---|
| 5,113,935 | A | 5/1992 | Jones et al. |
| 5,396,954 | A | 3/1995 | Brooks |
| 5,476,143 | A | 12/1995 | Sparlin et al. |
| 5,515,915 | A | 5/1996 | Jones et al. |
| 5,803,177 | A | 9/1998 | Hriscu et al. |
| 5,868,200 | A | 2/1999 | Bryant et al. |
| 5,890,533 | A | 4/1999 | Jones |
| 5,909,774 | A | 6/1999 | Griffith et al. |
| 6,059,032 | A | 5/2000 | Jones |
| 6,298,916 | B1 | 10/2001 | Tibbles et al. |
| 6,409,219 | B1 | 6/2002 | Broome et al. |
| 6,464,261 | B1 | 10/2002 | Dybevik et al. |
| 6,513,599 | B1 | 2/2003 | Bixenman et al. |
| 6,516,881 | B2 | 2/2003 | Hailey, Jr. |
| 6,557,634 | B2 | 5/2003 | Hailey, Jr. et al. |
| 6,575,251 | B2 | 6/2003 | Watson et al. |
| 6,581,682 | B1 | 6/2003 | Parent et al. |
| 6,581,689 | B2 | 6/2003 | Hailey, Jr. |
| 6,601,646 | B2 | 8/2003 | Streich et al. |
| 6,666,274 | B2 | 12/2003 | Hughes |
| 6,668,938 | B2 | 12/2003 | Sheffield et al. |
| 6,695,067 | B2 | 2/2004 | Johnson et al. |
| 6,749,023 | B2 | 6/2004 | Nguyen et al. |
| 6,749,024 | B2 | 6/2004 | Bixenman |
| 6,752,206 | B2 | 6/2004 | Watson et al. |
| 6,752,207 | B2 | 6/2004 | Danos et al. |
| 6,755,245 | B2 | 6/2004 | Nguyen et al. |
| 6,789,623 | B2 | 9/2004 | Hill, Jr. et al. |
| 6,814,139 | B2 | 11/2004 | Hejl et al. |
| 6,817,410 | B2 | 11/2004 | Wetzel et al. |
| 6,830,104 | B2 | 12/2004 | Nguyen et al. |
| 6,834,725 | B2 | 12/2004 | Whanger et al. |
| 6,854,522 | B2 | 2/2005 | Brezinski et al. |
| 6,883,608 | B2 | 4/2005 | Parlar et al. |
| 6,923,262 | B2 | 8/2005 | Broome et al. |
| 6,935,432 | B2 | 8/2005 | Nguyen |
| 6,983,796 | B2 | 1/2006 | Bayne et al. |
| 6,986,390 | B2 | 1/2006 | Doanne et al. |
| 6,997,263 | B2 | 2/2006 | Campbell et al. |
| 7,048,061 | B2 | 5/2006 | Bode et al. |
| 7,055,598 | B2 | 6/2006 | Ross et al. |
| 7,096,945 | B2 | 8/2006 | Richards et al. |
| 7,100,691 | B2 | 9/2006 | Nguyen et al. |
| 7,104,324 | B2 | 9/2006 | Wetzel et al. |
| 7,147,054 | B2 | 12/2006 | Wang et al. |
| 7,152,677 | B2 | 12/2006 | Parlar et al. |
| 7,207,383 | B2 | 4/2007 | Hurst et al. |
| 7,243,715 | B2 | 7/2007 | Wang et al. |
| 7,243,723 | B2 | 7/2007 | Surjaatmadja et al. |
| 7,243,724 | B2 | 7/2007 | McGregor et al. |
| 7,243,732 | B2 | 7/2007 | Richard |
| 7,252,142 | B2 | 8/2007 | Brezinski et al. |
| 7,264,047 | B2 | 9/2007 | Brezinski et al. |
| 7,264,061 | B2 | 9/2007 | Dybevik et al. |
| 7,278,479 | B2 | 10/2007 | Kvernstuen et al. |
| 7,343,983 | B2 | 3/2008 | Livingstone |
| 7,363,974 | B2 | 4/2008 | Wang et al. |
| 7,367,395 | B2 | 5/2008 | Vidrine et al. |
| 7,370,700 | B2 | 5/2008 | Hurst et al. |
| 7,373,978 | B2 | 5/2008 | Barry et al. |
| 7,407,007 | B2 | 8/2008 | Tibbles |
| 7,426,962 | B2 | 9/2008 | Moen et al. |
| 7,431,058 | B2 | 10/2008 | Holting |
| 7,431,085 | B2 | 10/2008 | Coronado et al. |
| 7,431,098 | B2 | 10/2008 | Ohmer et al. |
| 7,441,605 | B2 | 10/2008 | Coronado et al. |
| 7,493,959 | B2 | 2/2009 | Johnson et al. |
| 7,562,709 | B2 | 7/2009 | Saebi et al. |
| 7,584,799 | B2 | 9/2009 | Coronado et al. |
| 7,591,321 | B2 | 9/2009 | Whitsitt et al. |
| 7,597,141 | B2 | 10/2009 | Rouse et al. |
| 7,661,476 | B2 | 2/2010 | Yeh et al. |
| 7,874,354 | B2 | 1/2011 | Freyer |
| 7,938,184 | B2 | 5/2011 | Yeh et al. |
| 2003/0173075 | A1 | 9/2003 | Morvant et al. |
| 2004/0007829 | A1 | 1/2004 | Ross |
| 2004/0140089 | A1 | 7/2004 | Gunneroed |
| 2005/0028977 | A1 | 2/2005 | Ward |
| 2005/0061501 | A1 | 3/2005 | Ward et al. |
| 2005/0082060 | A1 | 4/2005 | Ward et al. |
| 2005/0263287 | A1 | 12/2005 | Achee, Jr. et al. |
| 2006/0000620 | A1 | 1/2006 | Hamilton |
| 2007/0056750 | A1 | 3/2007 | John et al. |
| 2007/0125532 | A1 | 6/2007 | Murray et al. |
| 2008/0125335 | A1 | 5/2008 | Bhavsar |
| 2008/0142222 | A1 | 6/2008 | Howard et al. |
| 2008/0156500 | A1 | 7/2008 | Macleod et al. |
| 2008/0314589 | A1 | 12/2008 | Guignard et al. |
| 2009/0008084 | A1 | 1/2009 | Dybevik et al. |
| 2009/0025923 | A1 | 1/2009 | Patel et al. |
| 2009/0065192 | A1* | 3/2009 | Lucas ..... 166/119 |
| 2009/0084556 | A1 | 4/2009 | Richards et al. |
| 2009/0159279 | A1 | 6/2009 | Assal |
| 2009/0283279 | A1* | 11/2009 | Patel et al. ..... 166/382 |
| 2009/0294128 | A1 | 12/2009 | Dale et al. |
| 2009/0308592 | A1 | 12/2009 | Mercer et al. |
| 2010/0000740 | A1 | 1/2010 | Dale et al. |
| 2010/0032158 | A1 | 2/2010 | Dale et al. |
| 2010/0065284 | A1 | 3/2010 | Freyer |
| 2010/0096119 | A1* | 4/2010 | Sevre et al. ..... 166/51 |
| 2010/0126722 | A1 | 5/2010 | Cornelissen et al. |
| 2010/0155064 | A1 | 6/2010 | Nutley et al. |
| 2010/0314125 | A1* | 12/2010 | Simancas et al. ..... 166/369 |
| 2011/0297368 | A1* | 12/2011 | Lembcke ..... 166/118 |
| 2013/0248178 | A1* | 9/2013 | Hecker et al. ..... 166/278 |
| 2013/0277053 | A1* | 10/2013 | Yeh et al. ..... 166/278 |

OTHER PUBLICATIONS

Haeberle, D. C. et al., "Application of Flow-Control Devices for Water Injection in the Erha Field", IADC/SPE 112726, Mar. 4-6, 2008, 2008 IADC/SPE Drilling Conference, Orlando, FL, pp. 1-9.

Helmy, M. W. et al., "Application of New Technology in the Completion of ERD Wells, Sakhalin-1 Development", SPE 103587, Oct. 3-6, 2006, 2006 SPE Russian Oil & Gas Technical Conference, pp. 12, Moscow, Russia.

* cited by examiner

OPEN-HOLE PACKER FOR ALTERNATE PATH GRAVEL PACKING, AND METHOD FOR COMPLETING AN OPEN-HOLE WELLBORE

CROSS REFERENCE TO RELATED APPLICATIONS

This application is the National Stage of International Application No. PCT/US2010/046329, filed Aug. 23, 2010, which claims the benefit of U.S. Provisional Application No. 61/263,120, filed Nov. 20, 2009.

BACKGROUND OF THE INVENTION

This section is intended to introduce various aspects of the art, which may be associated with exemplary embodiments of the present disclosure. This discussion is believed to assist in providing a framework to facilitate a better understanding of particular aspects of the present disclosure. Accordingly, it should be understood that this section should be read in this light, and not necessarily as admissions of prior art.

FIELD OF THE INVENTION

The present disclosure relates to the field of well completion. More specifically, the present invention relates to the isolation of formations in connections with wellbores that have been completed using gravel-packing.

DISCUSSION OF TECHNOLOGY

In the drilling of oil and gas wells, a wellbore is formed using a drill bit that is urged downwardly at a lower end of a drill string. After drilling to a predetermined depth, the drill string and bit are removed and the wellbore is lined with a string of casing. An annular area is thus formed between the string of casing and the formation. A cementing operation is typically conducted in order to fill or "squeeze" the annular area with cement. The combination of cement and casing strengthens the wellbore and facilitates the isolation of certain areas of the formation behind the casing.

It is common to place several strings of casing having progressively smaller outer diameters into the wellbore. Thus, the process of drilling and then cementing progressively smaller strings of casing is repeated several times until the well has reached total depth. The final string of casing, referred to as a production casing, is cemented into place. In some instances, the final string of casing is a liner, that is, a string of casing that is not tied back to the surface.

As part of the completion process, a wellhead is installed at the surface. Fluid gathering and processing equipment such as pipes, valves and separators are also provided. Production operations may then commence.

In connection with the production of non-condensable hydrocarbons, water may sometimes invade the formation. This may be due to the presence of native water zones, coning (rise of near-well hydrocarbon-water contact), high permeability streaks, natural fractures, and fingering from injection wells. Depending on the mechanism or cause of the water production, the water may be produced at different locations and times during a well's lifetime. In addition, undesirable condensable fluids such as hydrogen sulfide gas or acid gases may invade a formation.

Many completed wells include multiple zones in one more intervals that may be of extended lengths. During operation of wells having multiple zones, it is desirable to control and manage fluids produced from different zones. For example, in production operations, proper control of the fluid production rates in various zones can delay water or gas coning, helping to maximize reserve recovery.

Various techniques are known to determine whether zonal isolation will be effective or desirable for preventing the production of water or unwanted gas, and where in a well to position the zonal isolation. Exemplary implementations of zonal isolations and inflow control devices installed in wells have been documented in various publications, including M. W. Helmy, et al., "Application of New Technology in the Completion of ERD Wells, Sakhalin-1 Development," SPE Paper No. 103587 (October 2006); and David C. Haeberle, et al., "Application of Flow-Control Devices for Water Injection in the Erha Field", SPE Paper No. 112726 (March 2008). Careful installation of zonal isolation in the initial completion allows an operator to shut-off the production from one or more zones during the well lifetime to limit the production of water or, in some instances, an undesirable condensable fluid such as hydrogen sulfide.

Open-hole completions are oftentimes employed when multiple zones are sought to be produced. In open-hole completions, a production casing is not extended through the producing zones and perforated; rather, the producing zones are left uncased, or "open." A production string or "tubing" is then positioned inside the wellbore extending down below the last string of casing and across the formations of interest.

There are certain advantages to open-hole completions versus cased hole completions. First, because open-hole completions have no perforation tunnels, formation fluids can converge on the wellbore radially 360 degrees. This has the benefit of eliminating the additional pressure drop associated with converging radial flow and then linear flow through particle-filled perforation tunnels. The reduced pressure drop associated with an open-hole sand control completion virtually guarantees that it will be more productive than an unstimulated, cased hole in the same formation.

Second, open-hole gravel pack techniques are oftentimes less expensive than cased hole completions. For example, the use of gravel packs eliminates the need for cementing, perforating, and post-perforation clean-up operations. In some cases, the use of extended gravel packs avoids the need for an additional casing string or liner.

A common problem in open-hole completions is the immediate exposure of the wellbore to the surrounding formation. If the formation is unconsolidated or heavily sandy, the flow of production fluids into the wellbore may carry with it formation particles, e.g., sand and fines. Such particles can be erosive to production equipment downhole and to pipes, valves and separation equipment at the surface.

To control the invasion of sand and other particles, sand control devices may be employed. Sand control devices are usually installed downhole across formations to retain solid materials larger than a certain diameter while allowing fluids to be produced. The sand control device is typically an elongated tubular body, known as a base pipe, having numerous slotted openings. The base pipe is typically wrapped with a filtration medium such as a screen or wire mesh.

To augment the sand control devices, particularly in open-hole completions, it is common to install a gravel pack. Gravel packing a well involves placing gravel or other particulate matter around the sand control device after the sand control device is hung or otherwise placed in the wellbore. The gravel not only aids in particle filtration but also maintains formation integrity. Thus, in such an open-hole completion, the gravel is positioned between the wall of the wellbore and a sand screen that surrounds a perforated base pipe.

Formation fluids flow from the subterranean formation into the production string through the gravel, the screen, and the inner base pipe.

In connection with the installation of a gravel pack, a particulate material is delivered downhole by means of a carrier fluid. The carrier fluid with the gravel together forms a gravel slurry. A problem historically encountered with gravel-packing is that an inadvertent loss of carrier fluid from the slurry during the delivery process can result in sand or gravel bridges being formed at various locations along open-hole intervals. For example, in an inclined production interval or an interval having an enlarged or irregular borehole, a poor distribution of gravel may occur due to a premature loss of carrier fluid from the gravel slurry into the formation. The fluid loss may then cause voids to form in the gravel pack. Thus, a complete gravel-pack from bottom to top is not achieved.

Relatively recently, this problem has been addressed through the use of alternate path technology. Alternate path technology employs shunts that allow the gravel slurry to bypass selected areas along a wellbore. Such alternate path technology is described at least in PCT Publication No. WO 2008/060479, which is incorporated herein by reference in its entirety for all purposes, and M. D. Barry, et al., "Open-hole Gravel Packing with Zonal Isolation," SPE Paper No. 110460 (November 2007).

Zonal isolation in open-hole completions is desirable for establishing and maintaining optimized long-term performance of both injection and production wells. This ideally involves the placement and setting of packers before gravel packing commences. The packers would allow the operator to seal off an interval from either production or injection, depending on well function. However, packers historically have not been installed when an open-hole gravel pack is utilized because it is not possible to form a complete gravel pack above and below the packer.

PCT Publication Nos. WO 2007/092082 and WO 2007/092083 disclose apparatus' and methods for gravel-packing an open-hole wellbore after a packer has been set at a completion interval. These applications further disclose how zonal isolation in open-hole, gravel-packed completions may be provided by using a conventional packer element and secondary (or "alternate") flow paths to enable both zonal isolation and alternate path gravel packing. PCT Publication Nos. WO 2007/092082 and WO 2007/092083 are each incorporated herein by reference in their entireties for all purposes.

Certain technical challenges exist with respect to the methods disclosed in the incorporated PCT publications, particularly in connection with the packer. The applications state that the packer may be a hydraulically actuated inflatable element. Such an inflatable element may be fabricated from an elastomeric material or a thermoplastic material. However, designing a packer element from such materials requires the packer element to meet a particularly high performance level. In this respect, the packer element needs to be able to maintain zonal isolation for a period of years in the presence of high pressures and/or high temperatures and/or acidic fluids. As an alternative, the applications state that the packer may be a swelling rubber element that expands in the presence of hydrocarbons, water, or other stimulus. However, known swelling elastomers typically require about 30 days or longer to fully expand into sealed fluid engagement with the surrounding rock formation.

Therefore, what is needed is an improved sand control system that provides not only alternate flow path technology for the placement of gravel around a packer, but also an improved packer assembly for zonal isolation in an open-hole completion. Improved methods are also needed for isolating selected intervals of a subsurface formation in an open-hole wellbore.

SUMMARY OF THE INVENTION

A gravel pack zonal isolation apparatus for a wellbore is provided herein. The zonal isolation apparatus has utility in connection with the placement of a gravel pack within an open-hole portion of the wellbore. The open-hole portion extends through one, two, or more subsurface intervals.

In one embodiment, the zonal isolation apparatus includes an elongated base pipe. The base pipe defines a tubular member having an upper end and a lower end. Preferably, the zonal isolation apparatus further comprises a filter medium surrounding the base pipe along a substantial portion of the base pipe. Together, the base pipe and the filter medium form a sand screen.

The zonal isolation apparatus also includes at least one and, more preferably, at least two packer assemblies. Each packer assembly comprises at least two mechanically set packer elements. These represent an upper packer and a lower packer. The upper and lower packers preferably comprise mechanically set packer elements that are about 6 inches to 24 inches in length.

Intermediate the at least two mechanically set packer elements is at least one swellable packer element. The swellable packer element is preferably about 3 feet to 40 feet in length. In one aspect, the swellable packer element is fabricated from an elastomeric material. The swellable packer element is actuated over time in the presence of a fluid such as water, gas, oil, or a chemical. Swelling may take place, for example, should one of the mechanically set packer elements fails. Alternatively, swelling may take place over time as fluids in the formation surrounding the swellable packer element contact the swellable packer element.

The swellable packer element preferably swells in the presence of an aqueous fluid. In one aspect, the swellable packer element may include an elastomeric material that swells in the presence of hydrocarbon liquids or an actuating chemical. This may be in lieu of or in addition to an elastomeric material that swells in the presence of an aqueous fluid.

In one aspect, the elongated base pipe comprises multiple joints of pipe connected end-to-end. The gravel pack zonal isolation apparatus may include an upper packer assembly and a lower packer assembly placed along the joints of pipe. The upper packer assembly and the lower packer assembly can be spaced apart along the joints of pipe so as to isolate a selected subsurface interval within a wellbore.

The zonal isolation apparatus also includes one or more alternate flow channels. The alternate flow channels are disposed outside of the base pipe and along the various packer elements within each packer assembly. The alternate flow channels serve to divert gravel pack slurry from an upper interval to one or more lower intervals during a gravel packing operation.

A method for completing an open-hole wellbore is also provided herein. In one aspect, the method includes running a gravel pack zonal isolation apparatus into the wellbore. The wellbore includes a lower portion completed as an open-hole. The zonal isolation apparatus is in accordance with the zonal isolation apparatus described above.

Next, the zonal isolation apparatus is hung in the wellbore. The apparatus is positioned such that the at least one packer assembly is positioned essentially between production intervals of the open-hole portion of the wellbore. Then, the mechanically set packers in each of the at least one packer assembly are set.

The method also includes injecting a particulate slurry into an annular region formed between the sand screen and the surrounding subsurface formation. The particulate slurry is made up of a carrier fluid and sand (and/or other) particles. The one or more alternate flow channels of the zonal isolation apparatus allow the particulate slurry to travel through or around the mechanically set packer elements and the intermediate swellable packer element. In this way, the open-hole portion of the wellbore is gravel packed above and below (but not between) the mechanically set packer elements.

The method also includes producing production fluids from one or more production intervals along the open-hole portion of the wellbore, or injecting injection fluids into the open-hole portion of the wellbore. Production or injection takes place for a period of time. Over the period of time, the upper packer, the lower packer, or both, may fail, permitting the inflow of fluids into an intermediate portion of the packer along the swellable packer element. Alternatively, the intermediate swellable packer may swell due to contact with formation fluids or an actuating chemical. Contact with fluids will cause the swellable packer element to swell, thereby providing a long term seal beyond the life of the mechanically set packers.

BRIEF DESCRIPTION OF THE DRAWINGS

So that the manner in which the present inventions can be better understood, certain illustrations, charts and/or flow charts are appended hereto. It is to be noted, however, that the drawings illustrate only selected embodiments of the inventions and are therefore not to be considered limiting of scope, for the inventions may admit to other equally effective embodiments and applications.

DETAILED DESCRIPTION OF CERTAIN EMBODIMENTS

Definitions

As used herein, the term "hydrocarbon" refers to an organic compound that includes primarily, if not exclusively, the elements hydrogen and carbon. Hydrocarbons generally fall into two classes: aliphatic, or straight chain hydrocarbons, and cyclic, or closed ring hydrocarbons, including cyclic terpenes. Examples of hydrocarbon-containing materials include any form of natural gas, oil, coal, and bitumen that can be used as a fuel or upgraded into a fuel.

As used herein, the term "hydrocarbon fluids" refers to a hydrocarbon or mixtures of hydrocarbons that are gases or liquids. For example, hydrocarbon fluids may include a hydrocarbon or mixtures of hydrocarbons that are gases or liquids at formation conditions, at processing conditions or at ambient conditions (15° C. and 1 atm pressure). Hydrocarbon fluids may include, for example, oil, natural gas, coal bed methane, shale oil, pyrolysis oil, pyrolysis gas, a pyrolysis product of coal, and other hydrocarbons that are in a gaseous or liquid state.

As used herein, the term "fluid" refers to gases, liquids, and combinations of gases and liquids, as well as to combinations of gases and solids, and combinations of liquids and solids.

As used herein, the term "condensable hydrocarbons" means those hydrocarbons that condense at about 15° C. and one atmosphere absolute pressure. Condensable hydrocarbons may include, for example, a mixture of hydrocarbons having carbon numbers greater than 4.

As used herein, the term "subsurface" refers to geologic strata occurring below the earth's surface.

The term "subsurface interval" refers to a formation or a portion of a formation wherein formation fluids may reside. The fluids may be, for example, hydrocarbon liquids, hydrocarbon gases, aqueous fluids, or combinations thereof.

As used herein, the term "wellbore" refers to a hole in the subsurface made by drilling or insertion of a conduit into the subsurface. A wellbore may have a substantially circular cross section, or other cross-sectional shape. As used herein, the term "well", when referring to an opening in the formation, may be used interchangeably with the term "wellbore."

The term "tubular member" refers to any pipe, such as a joint of casing, a portion of a liner, or a pup joint.

The term "sand control device" means any elongated tubular body that permits an inflow of fluid into an inner bore or a base pipe while filtering out sand, fines and granular particles from a surrounding formation.

The term "alternative flowpath channels" means any collection of manifolds and/or jumper tubes that provide fluid communication through or around a packer to allow a gravel slurry to by-pass the packer in order to obtain full gravel packing of an annular region around a sand control device.

Description of Specific Embodiments

Figure 1:
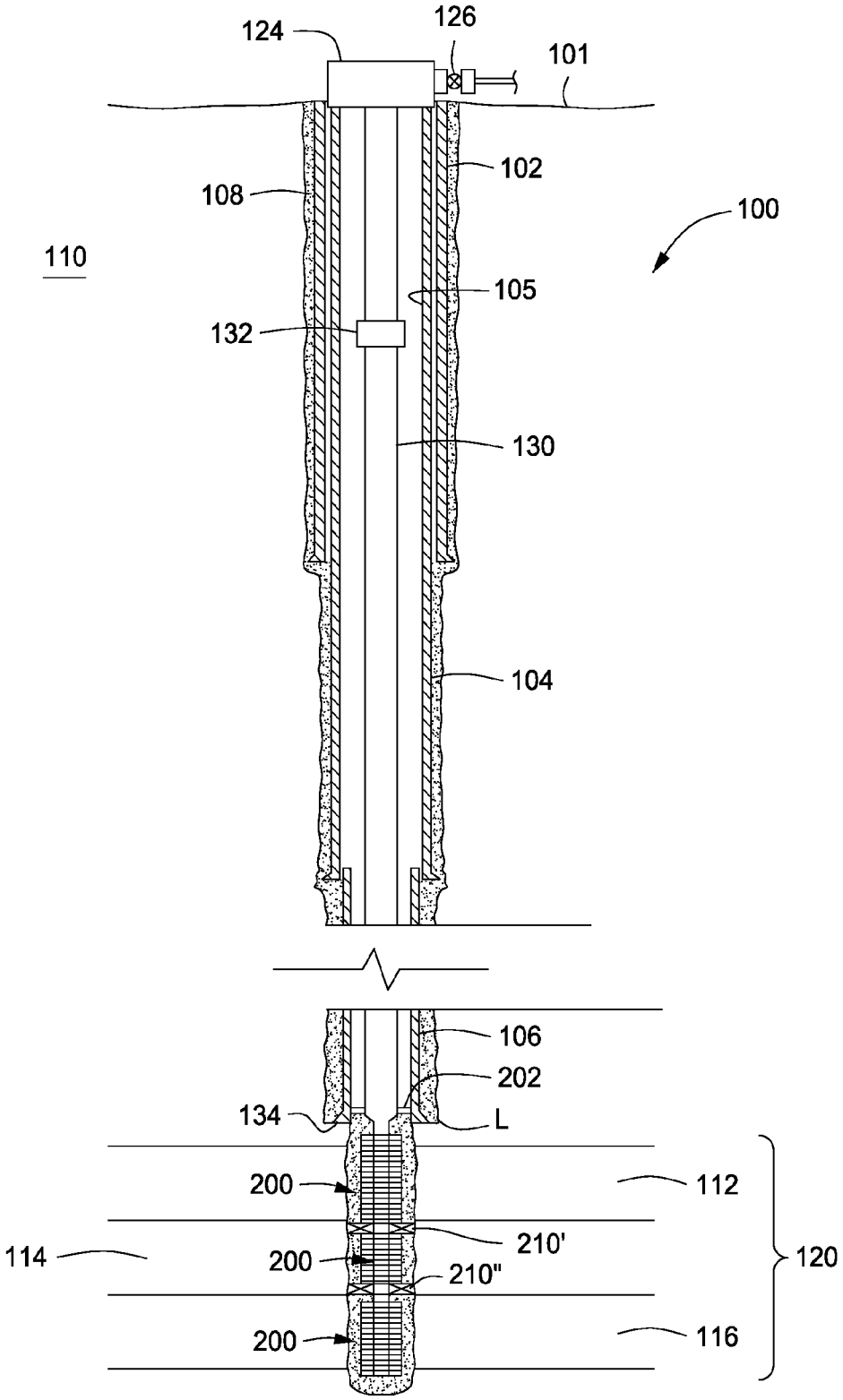
FIG. 1 is a cross-sectional view of an illustrative wellbore. The wellbore has been drilled through three different subsurface intervals, each interval being under formation pressure and containing fluids.

FIG. 1 is a cross-sectional view of an illustrative wellbore 100. The wellbore 100 defines a bore 105 that extends from a surface 101, and into the earth's subsurface 110. The wellbore 100 is completed to have an open-hole portion 120 at a lower end of the wellbore 100. The wellbore 100 has been formed for the purpose of producing hydrocarbons for commercial sale. A string of production tubing 130 is provided in the bore 105 to transport production fluids from the open-hole portion 120 up to the surface 101.

The wellbore 100 includes a well tree, shown schematically at 124. The well tree 124 includes a shut-in valve 126. The shut-in valve 126 controls the flow of production fluids from the wellbore 100. In addition, a subsurface safety valve 132 is provided to block the flow of fluids from the production tubing 130 in the event of a rupture or break above the subsurface safety valve 132. The wellbore 100 may optionally have a pump (not shown) within or just above the open-hole portion 120 to artificially lift production fluids from the open-hole portion 120 up to the well tree 124.

The wellbore 100 has been completed by setting a series of pipes into the subsurface 110. These pipes include a first string of casing 102, sometimes known as surface casing or a conductor. These pipes also include at least a second 104 and a third 106 string of casing. These casing strings 104, 106 are intermediate casing strings that provide support for walls of the wellbore 100. Intermediate casing strings 104, 106 may be hung from the surface, or they may be hung from a next higher casing string using an expandable liner or a liner hanger. It is understood that a pipe string that does not extend back to the surface (such as casing string 106) is normally referred to as a "liner."

In the illustrative arrangement of FIG. 1, intermediate casing string 104 is hung from the surface 101, while casing string 106 is hung from a lower end of casing string 104. Additional intermediate casing strings (not shown) may be employed. The present inventions are not limited to the type of casing arrangement used.

Each string of casing 102, 104, 106 is set in place through cement 108. The cement 108 isolates the various formations of the subsurface 110 from the wellbore 100 and each other. The cement 108 extends from the surface 101 to a depth "L" at a lower end of the casing string 106.

In many wellbores, a final casing string known as production casing is cemented into place at a depth where subsurface production intervals reside. However, the illustrative wellbore 100 is completed as an open-hole wellbore. Accordingly, the wellbore 100 does not include a final casing string along the open-hole portion 120. The open-hole portion of the wellbore 100 is shown at bracket 120.

In the illustrative wellbore 100, the open-hole portion 120 traverses three different subsurface intervals. These are indicated as upper interval 112, intermediate interval 114, and lower interval 116. Upper interval 112 and lower interval 116 may, for example, contain valuable oil deposits sought to be produced, while intermediate interval 114 may contain primarily water or other aqueous fluid within its pore volume. Alternatively, upper 112 and intermediate 114 intervals may contain hydrocarbon fluids sought to be produced, processed and sold, while lower interval 116 may contain some oil along with ever-increasing amounts of water. Alternatively still, upper 112 and lower 116 intervals may be producing hydrocarbon fluids from a sand or other permeable rock matrix, while intermediate interval 114 may represent a non-permeable shale or otherwise be substantially impermeable to fluids.

In any of these events, it is desirable for the operator to isolate selected intervals. In the first instance, the operator will want to isolate the intermediate interval 114 from the production string 130 and from the upper 112 and lower 116 intervals so that primarily hydrocarbon fluids may be produced through the wellbore 100 and to the surface 101. In the second instance, the operator will eventually want to isolate the lower interval 116 from the production string 130 and the upper 112 and intermediate 114 intervals so that primarily hydrocarbon fluids may be produced through the wellbore 100 and to the surface 101. In the third instance, the operator will want to isolate the upper interval 112 from the lower interval 116, but need not isolate the intermediate interval 114. Solutions to these needs in the context of an open-hole completion are provided herein, and are demonstrated more fully in connection with the proceeding drawings.

It is noted here that in connection with the production of hydrocarbon fluids from a wellbore having an open-hole completion, it is desirable to limit the influx of sand particles and other fines. In order to prevent the migration of formation particles into the production string 130 during operation, various sand control devices 200 have been run into the wellbore 100. These are described more fully below in connection with FIG. 2 and with FIGS. 5A through 5N.

In one embodiment, the sand control devices 200 contain an elongated tubular body referred to as a base pipe 205. The base pipe 205 typically is made up of a plurality of pipe joints. The base pipe 205 (or each pipe joint making up the base pipe 205) typically has small perforations or slots to permit the inflow of production fluids. The sand control devices 200 typically also contain a filter medium 207 radially around the base pipes 205. The filter medium 207 is preferably a combination of wire-mesh screens or wire-wrapped screens fitted around the base pipe 205. The mesh or screens serve as filters 207 to prevent the inflow of sand or other particles into the production tubing 130.

Other embodiments of sand control devices may be used with the apparatuses and methods herein. For example, the sand control devices 200 may include stand-alone screens (SAS), pre-packed screens, or membrane screens.

In addition to the sand control devices 200, the wellbore 100 includes one or more packer assemblies 210. In the illustrative arrangement of FIG. 1, the wellbore 100 has an upper packer assembly 210' and a lower packer assembly 210". However, additional packer assemblies 210 or just one packer assembly 210 may be used. The packer assemblies 210', 210" are uniquely configured to seal an annular region (seen at 202 of FIG. 2) between the various sand control devices 200 and a surrounding wall 201 of the open-hole portion 120 of the wellbore 100.

Figure 2:
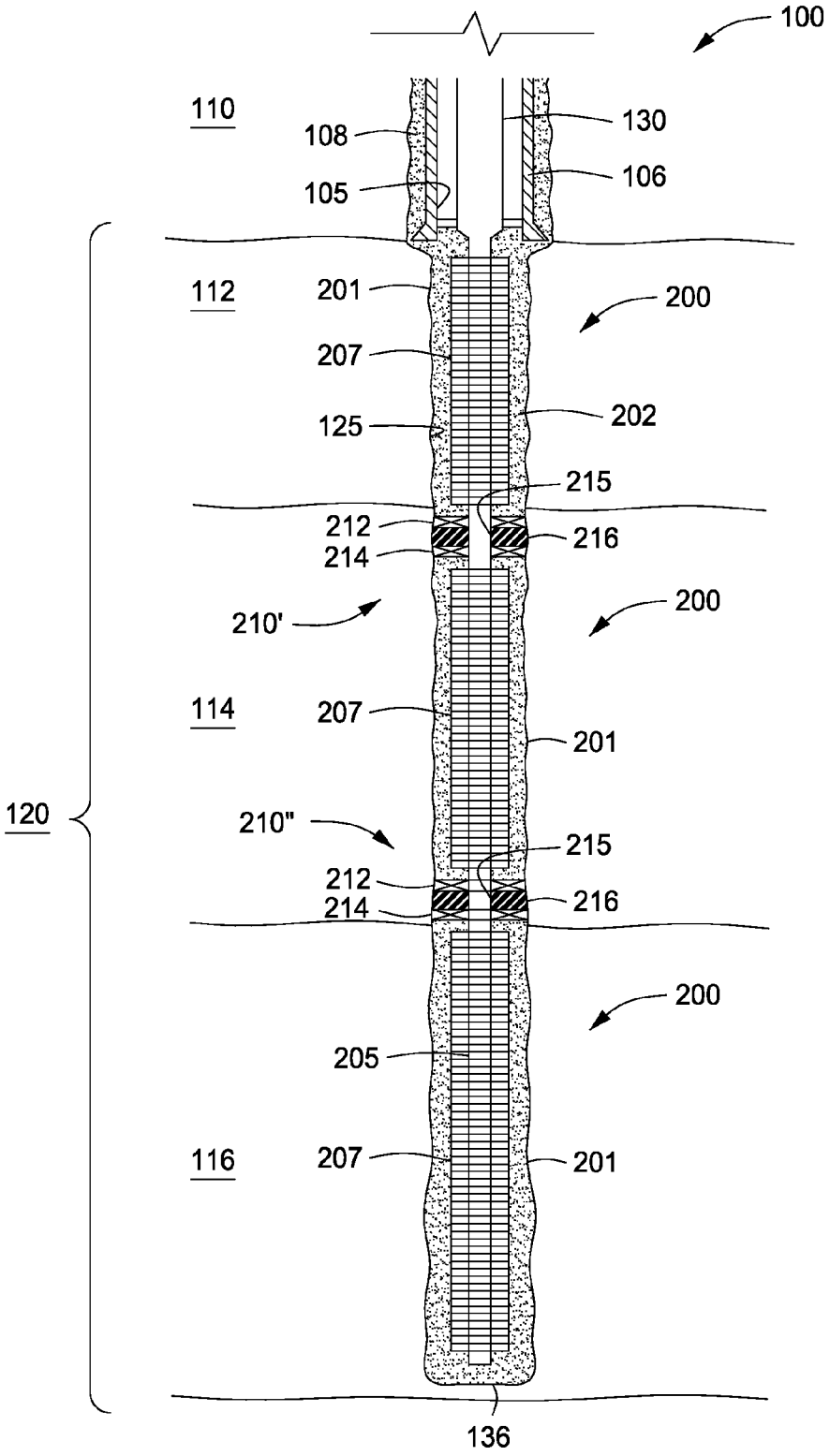
FIG. 2 is an enlarged cross-sectional view of an open-hole completion of the wellbore of FIG. 1. The open-hole completion at the depth of the three intervals is more clearly seen.

FIG. 2 is an enlarged cross-sectional view of the open-hole portion 120 of the wellbore 100 of FIG. 1. The open-hole portion 120 or completion and the three intervals 112, 114, 116 are more clearly seen. The upper 210' and lower 210" packer assemblies are also more clearly visible proximate upper and lower boundaries of the intermediate interval 114. Finally, the sand control devices 200 within each of the intervals 112, 114, 116 are shown.

Concerning the packer assemblies themselves, each packer assembly 210', 210" contains at least two packer elements. The packer elements or packers are preferably set hydraulically or hydrostatically, though some mechanical manipulation may be required for actuation. The packer assemblies represent an upper packer element 212 and a lower packer element 214. Each packer element 212, 214 defines an expandable portion fabricated from an elastomeric or a thermoplastic material capable of providing at least a temporary fluid seal against the surrounding wellbore wall 201.

The upper 212 and lower 214 packer elements should be able to withstand the pressures and loads associated with a gravel packing process. Typically, such pressures are from about 2,000 psi to 3,000 psi. The sealing surface for the mechanically set packers 212, 214 need only be on the order of inches. In one aspect, the upper mechanically set packer element 212 and the lower mechanically set packer element 214 is each about 2 inches to about 36 inches in length; more preferably, the elements 212, 214 are about 6 inches to 24 inches in length.

The packer elements 212, 214 are preferably cup-type elements. The cup-type elements need not be liquid tight, nor must they be rated to handle multiple pressure and temperature cycles. The cup-type elements need only be designed for one-time use, to wit, during the gravel packing process of an open-hole wellbore completion.

It is preferred for the packer elements 212, 214 to be able to expand to at least an 11-inch (about 28 cm) outer diameter surface, with no more than a 1.1 ovality ratio. The elements 212, 214 should preferably be able to handle washouts in an 8½ inch (about 21.6 cm) or 9⅞ inch (about 25.1 cm) open-hole section 120. The preferred cup-type nature of the expandable portions of the packer elements 212, 214 will assist in maintaining a seal against the wall 201 of the intermediate interval 114 (or other interval) as pressure increases during the gravel packing operation.

The upper 212 and lower 214 packer elements are set during a gravel pack installation process. The packer elements 212, 214 are preferably set by shifting a sleeve (not shown) along a mandrel 215 supporting the packer elements 212, 214. In one aspect, shifting the sleeve allows hydrostatic pressure to expand the expandable portion defining the packer elements 212, 214 against the wellbore wall 201. The expandable portions of the upper 212 and lower 214 packer elements are expanded into contact with the surrounding wall 201 so as to straddle the annular region 202 (or annulus) along a selected interval in the subsurface formation 110. In the illustrative arrangement of FIG. 1, the selected interval is the intermediate interval 114. However, it is understood that a packer assembly 210 may be placed at any point within the open-hole completion 120.

Cup-type elements are known for use in cased-hole completions. However, they generally are not known for use in open-hole completions as they are not engineered to expand into engagement with an open hole diameter. Moreover, such expandable cup-type elements may not maintain the required pressure differential encountered during production operations, resulting in decreased functionality. Applicants are familiar with various cup-type elements available from suppliers. However, there is concern that such a cup-type packer element may fail during expansion, not set completely, or partially fail during gravel pack operations. Therefore, as a "back-up" the packer assemblies 210', 210" also each include an intermediate packer element 216.

The intermediate packer element 216 defines a swelling elastomeric material fabricated from synthetic rubber compounds. Suitable examples of swellable materials may be found in Easy Well Solutions' CONSTRICTOR™ or SWELLPACKER™, and Swellfix's E-ZIP™. The swellable packer 216 may include a swellable polymer or swellable polymer material, which is known by those skilled in the art and which may be set by one of a conditioned drilling fluid, a completion fluid, a production fluid, an injection fluid, a stimulation fluid, or any combination thereof.

The swellable packer element 216 is preferably bonded to the outer surface of the mandrel 215. The swellable packer element 216 is allowed to expand over time when contacted by hydrocarbon fluids, formation water, or any chemical described above which may be used as an actuating fluid. As the packer element 216 expands, it forms a fluid seal with the surrounding zone, e.g., interval 114. In one aspect, a sealing surface of the swellable packet element 216 is from about 5 feet to 50 feet in length; and more preferably, about 3 feet to 40 feet in length.

The thickness and length of the swellable packer element 216 must be able to expand to the wellbore wall 201 and provide the required pressure integrity at that expansion ratio. Since swellable packers are typically set in a shale section that may not produce hydrocarbon fluids, it is preferable to have a swelling elastomer or other material that can swell in the presence of formation water or an aqueous-based fluid. Examples of materials that will swell in the presence of an aqueous-based fluid are bentonite clay and a nitrile-based polymer with incorporated water absorbing particles.

Alternatively, the swellable packer element 216 may be fabricated from a combination of materials that swell in the presence of water and oil, respectively. Stated another way, the swellable packer element 216 may include two types of swelling elastomers—one for water and one for oil. In this situation, the water-swellable element will swell when exposed to the water-based gravel pack fluid or in contact with formation water, and the oil-based element will expand when exposed to hydrocarbon production. An example of an elastomeric material that will swell in the presence of a hydrocarbon liquid is oleophilic polymer that absorbs hydrocarbons into its matrix. The swelling occurs from the absorption of the hydrocarbons which also lubricates and decreases the mechanical strength of the polymer chain as it expands. Ethylene propylene diene monomer (M-class) rubber, or EPDM, is one example of such a material.

If only a hydrocarbon swelling elastomer is used, expansion of the element may not occur until after the failure of either of the mechanically set packer elements 212, 214. In this respect, the mechanically set packer elements 212, 214 are preferably set in a water-based gravel pack fluid that would be diverted around the swellable packer element 216.

In order to bypass the placement of gravel around the packer assemblies 210, an alternate flowpath is provided. FIGS. 3A to 3D present an illustrative packer assembly 300 as may be used in the present inventions, in one embodiment. The packer assembly 300 employs individual shunt tubes (seen in phantom at 318) to provide an alternative flowpath for a particulate slurry. More specifically, the shunt tubes 318 transport a carrier fluid along with gravel to different intervals 112, 114 and 116 of the open-hole portion 120 of the wellbore 100.

Figure 3A:
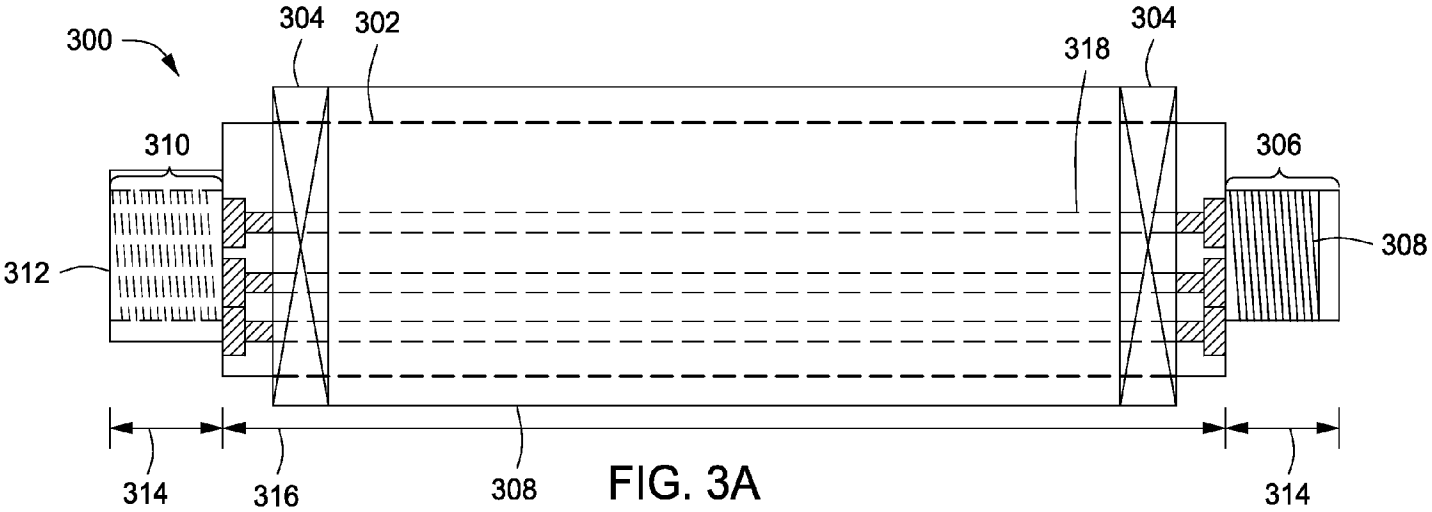
FIGS. 3A to 3D present an illustrative packer assembly as may be used in the present inventions, in one embodiment. The packer assembly employs individual shunt tubes to provide an alternative flowpath for a particulate slurry.

Referring now to FIG. 3A, FIG. 3A is a side view of an illustrative packer assembly 300, in one embodiment. The packer assembly 300 includes various components that are utilized to isolate an interval, such as interval 114, within the subsurface formation along the open-hole portion 120. The packer assembly 300 first includes a main body section 302. The main body section 302 is preferably fabricated from steel or steel alloys. The main body section 302 is configured to be a specific length 316, such as about 40 feet. The main body section 302 comprises individual pipe joints that will have a length that is between about 10 feet and 50 feet. The pipe joints are typically threadedly connected to form the main body section 302 according to length 316.

The packer assembly 300 also includes elastomeric, mechanically-set expansion elements 304. The elastomeric expansion elements 304 are in accordance with mechanically-set packer elements 212 and 214 of FIG. 2. The elastomeric expansion elements 304 are preferably a cup-type element that is less than a foot in length.

The packer assembly 300 also includes a swellable packer element 308. The swellable packer element 308 is in accordance with swellable packer element 216 of FIG. 2. The swellable packer element 308 is preferably about 3 to 40 feet in length. Together, the elastomeric expansion elements 304 and the swellable packer element 308 surround the main body section 302.

Figure 3B:
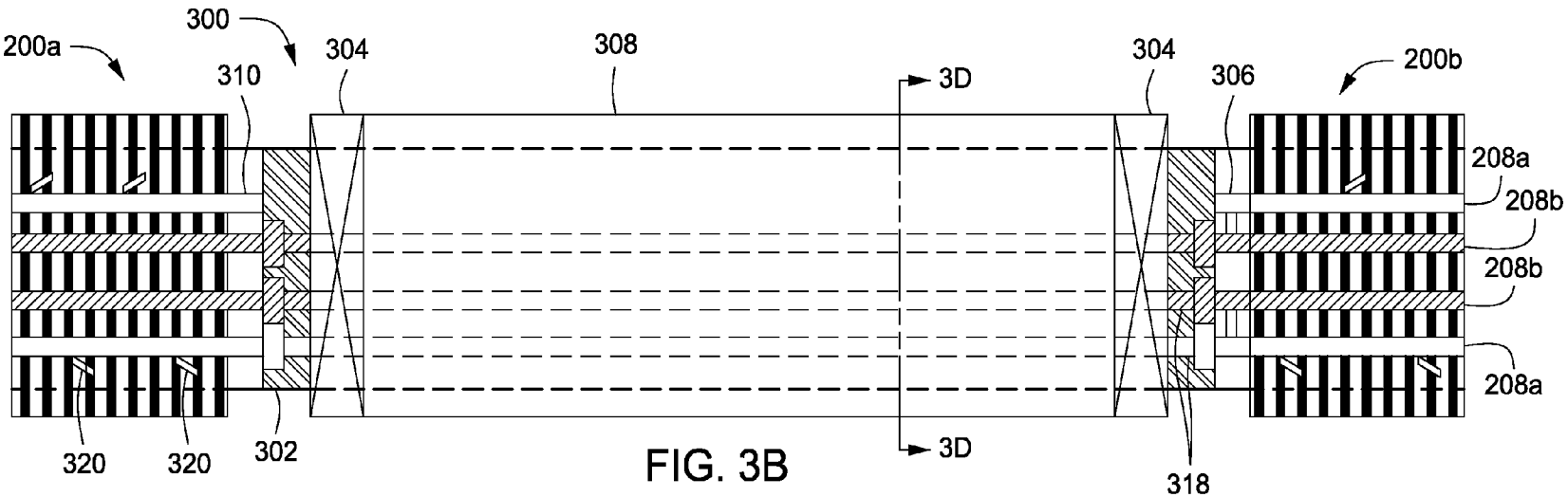

As noted, the packer assembly 300 further includes shunt tubes 318. The shunt tubes 318 may also be referred to as transport or jumper tubes. The shunt tubes 318 are blank sections of pipe having a length that extends along the length 316 of the elastomeric expansion elements 304 and the swellable packer element 308 together. The shunt tubes 318 on the packer assembly 300 are configured to couple to and form a seal with shunt tubes on the sand control devices 200. The shunt tubes on the sand control devices 200 are seen in FIG. 3B at 208*a* and 208*b*. In this way, gravel slurry may be transported around the packer elements 304, 308.

FIG. 3B is another side view of the packer assembly 300 of FIG. 3A. In this view, the packer assembly 300 is connected at opposing ends to sand control devices 200*a*, 200*b*. The shunt tubes 318 on the packer assembly 300 are seen connected to the shunt tubes 208*a*, 208*b* on the sand control devices 200*a*, 200*b*. The shunt tubes 208*a*, 208*b* preferably include a valve 320 to prevent fluids from an isolated interval from flowing through the shunt tubes 200*a*, 200*b* to another interval.

As seen in FIGS. 3A and 3B, the packer assembly 300 also includes a neck section 306 and a notched section 310. The neck section 306 and notched section 310 may be made of steel or steel alloys with each section configured to be a specific length 314, such as 4 inches to 4 feet (or other suitable distance). The neck section 306 and notched section 310 have specific internal and outer diameters. The neck section 306 may have external threads 308 and the notched section 310 may have internal threads 312. These threads 308 and 312 (seen in FIG. 3A) may be utilized to form a seal between the packer assembly 300 and the opposing sand control devices 200*a*, 200*b* or another pipe segment.

The configuration of the packer assembly 300 may be modified for external shunt tubes or for internal shunt tubes. In FIGS. 3A and 3B, the packer assembly 300 is configured to have external shunt tubes 208*a*, 208*b*. However, FIG. 3C is offered to show the packer assembly 300 having internal shunt tubes 352.

Figure 3C:
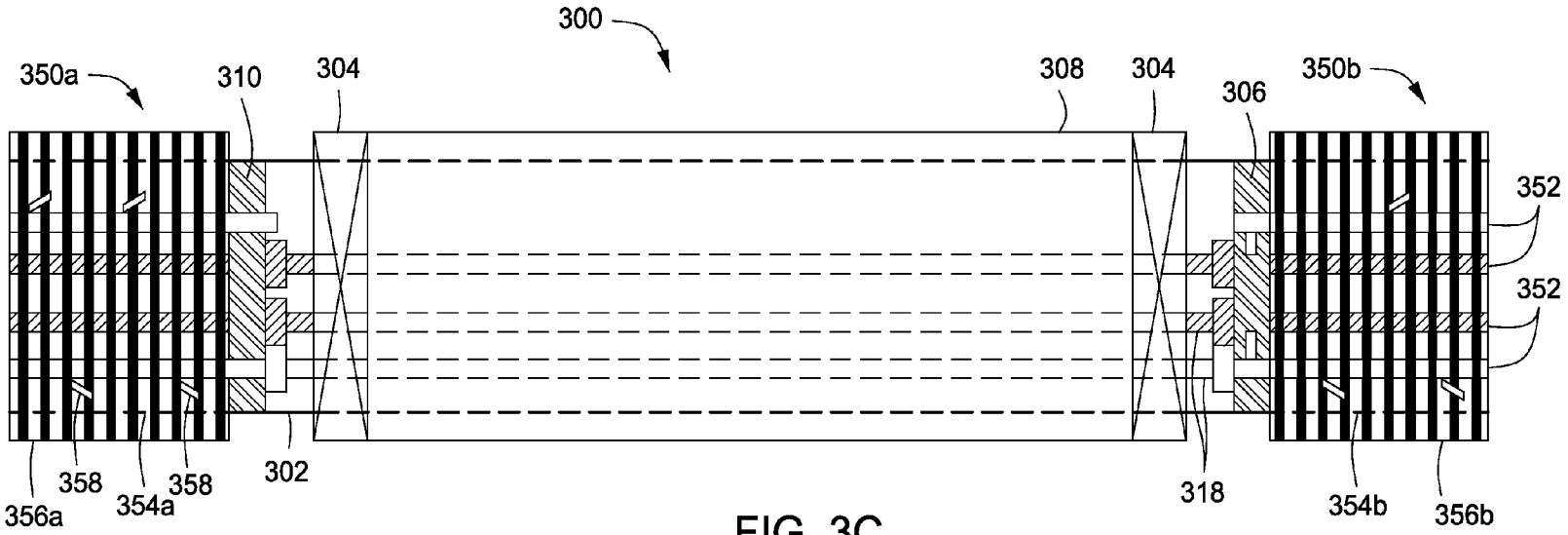

FIG. 3C presents a side view of the packer assembly 300 connected at opposing ends to sand control devices 350*a*, 350*b*. The sand control devices 350*a*, 350*b* are similar to sand control devices 200*a*, 200*b* of FIG. 3B. However, in FIG. 3B, the sand control devices 350*a*, 350*b* utilize internal shunt tubes 352 disposed between base pipes 354*a* and 354*b* and filter mediums or sand screens 356*a* and 356*b*, respectively.

In each of FIGS. 3B and 3C, the neck section 306 and notched section 310 of the packer assembly 300 is coupled with respective sections of the sand control devices 200*a*, 200*b* or 350*a*, 350*b*. These sections may be coupled together by engaging the threads 308 and 312 to form a threaded connection. Further, the jumper tubes 318 of the packer assembly 300 may be coupled individually to the shunt tubes 208*a*, 208*b* or 352. Because the jumper tubes 318 are configured to pass through the mechanically-set expansion elements 304 and the swellable expansion element 308, the shunt tubes 318 form a continuous flow path through the packer assembly 300 for the gravel slurry.

Figure 3D:
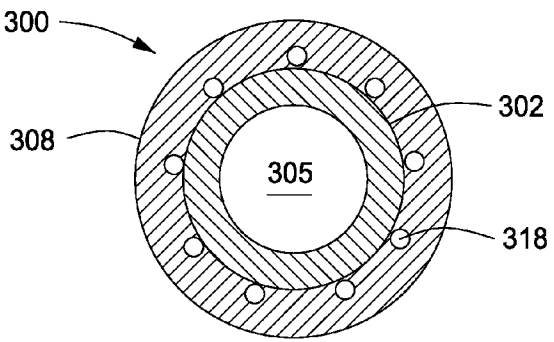

A cross-sectional view of the various components of the packer assembly 300 is shown in FIG. 3D. FIG. 3D is taken along the line 3D-3D of FIG. 3B. In FIG. 3D, the swellable packer element 308 is seen circumferentially disposed around the base pipe 302. Various shunt tubes 318 are placed radially and equidistantly around the base pipe 302. A central bore 305 is shown within the base pipe 302. The central bore 305 receives production fluids during production operations and conveys them to the production tubing 130.

FIGS. 4A to 4D present an illustrative packer assembly 400 as may be used in the present inventions, in an alternate embodiment. The packer assembly 400 employs individual shunt tubes to provide an alternative flowpath for a particulate slurry. In this instance, the packer assembly 400 is utilized with a manifold or opening 420. The manifold 420 provides a fluid communication path between multiple shunt tubes 352 in a sand control device 200. The manifold 420, which may also be referred to as a manifold region or manifold connection, may be utilized to couple to external or internal shunt tubes of different geometries without the concerns of alignment that may be present in other configurations.

Figure 4A:
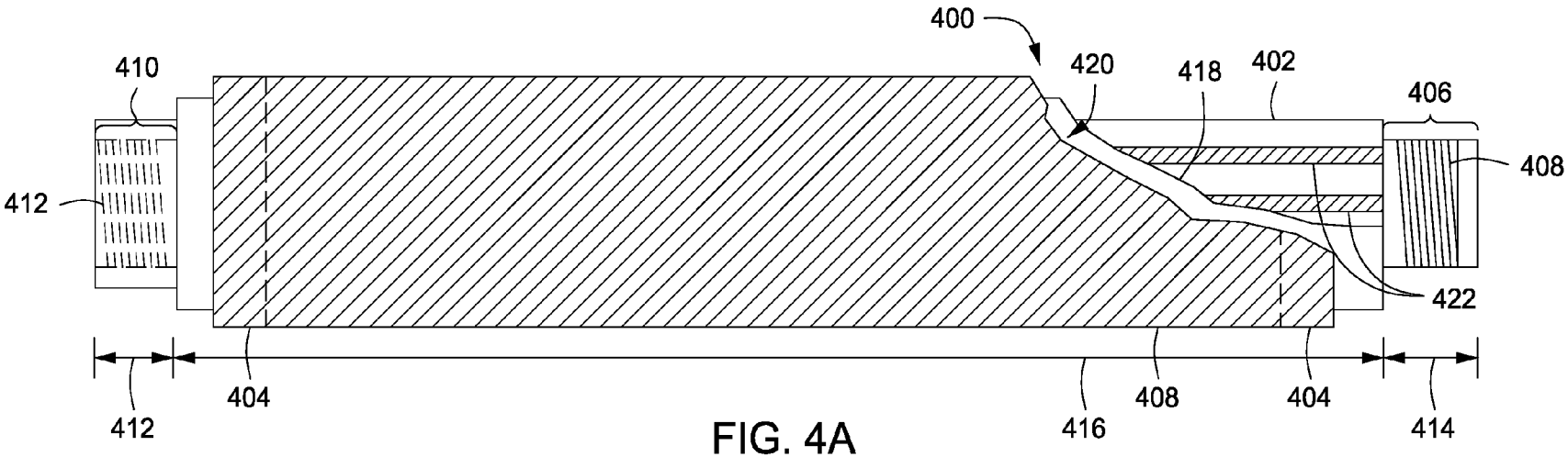
FIGS. 4A to 4D provide an illustrative packer assembly as may be used in the zonal isolation apparatus and in the methods herein, in an alternate embodiment.

Referring now to FIG. 4A, FIG. 4A shows a side, cut-away view of the packer assembly 400. The packer assembly 400 includes various components that are utilized to isolate a subsurface interval, such as interval 114 in open-hole portion 120. The packer assembly 400 includes a main body section 402. The main body section 402 is an elongated tubular body that extends the length of the packer assembly 400.

The packer assembly 400 also includes a sleeve section 418. The sleeve section 418 is a second tubular body that surrounds the main body section 402. The sleeve section 418 creates the opening or manifold 420, which is essentially an annular region between the main body section 402 and the surrounding sleeve section 418.

The main body section 402 and the sleeve section 418 may be fabricated from steel or steel alloys. The main body section 402 and the sleeve section 418 may are configured to be a specific length 416, such as between 6 inches and up to 50 feet. Preferably, the main body section 402 and the sleeve section 418 together are about 20 to 30 feet in length.

Figure 4B:
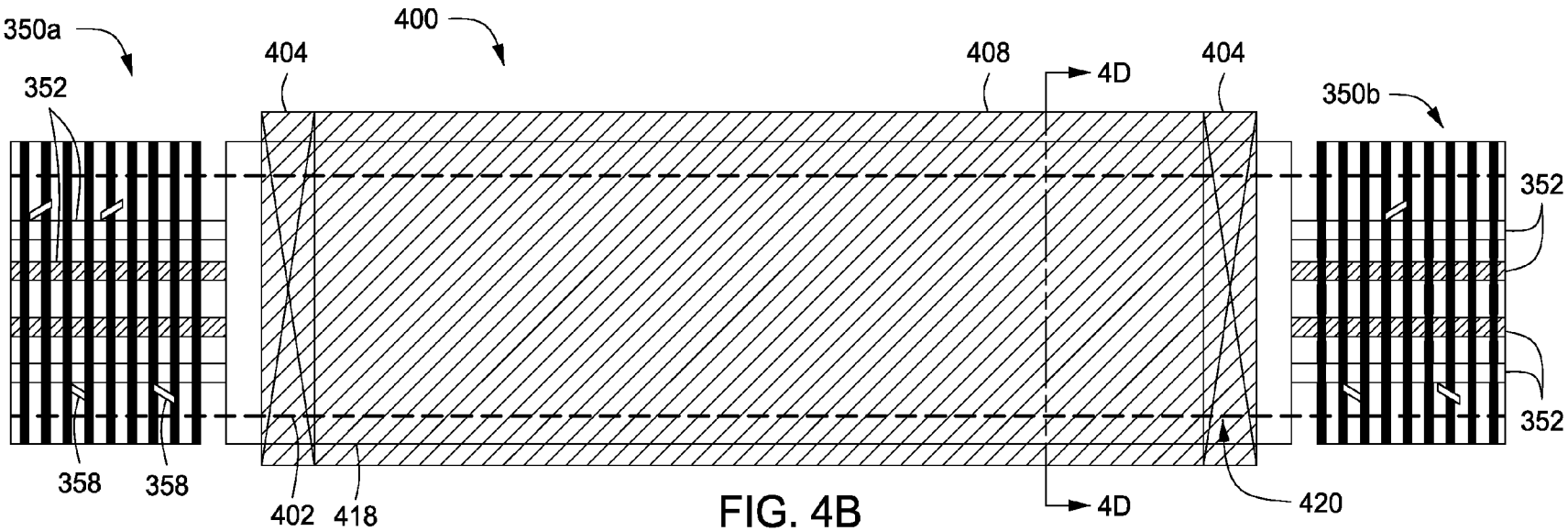

The sleeve section 418 may be configured to couple to and form a seal with shunt tubes, such as shunt tubes 208 on sand control devices 200. In the arrangement of FIGS. 4A and 4B, shunt tubes 352 are provided.

The packer assembly 400 also includes elastomeric, mechanically-set expansion elements 404. Specifically, an upper mechanically set element and a lower mechanically set element are provided. The elastomeric expansion elements 404 are in accordance with mechanically-set packer elements 212 and 214 of FIG. 2. The elastomeric expansion elements 404 are preferably cup-type elements that are less than a foot in length.

The packer assembly 400 further includes a swellable packer element 408. The swellable packer element 408 is in accordance with swellable packer element 216 of FIG. 2. The swellable packer element 408 is preferably about 3 to 40 feet in length, though other lengths may be employed. Together, the elastomeric expansion elements 404 and the swellable packer element 408 surround the main body section 302.

The packer assembly 400 also includes support segments 422. The support segments 422 are utilized to form the manifold 420. The support segments 422 are placed between the main body section 402 and the sleeve section 418, that is, within the manifold 420. The support segments 422 provide support for the elastomeric expansion element 404 and the swellable packer element 408 as well as the sleeve section 418.

Figure 4C:
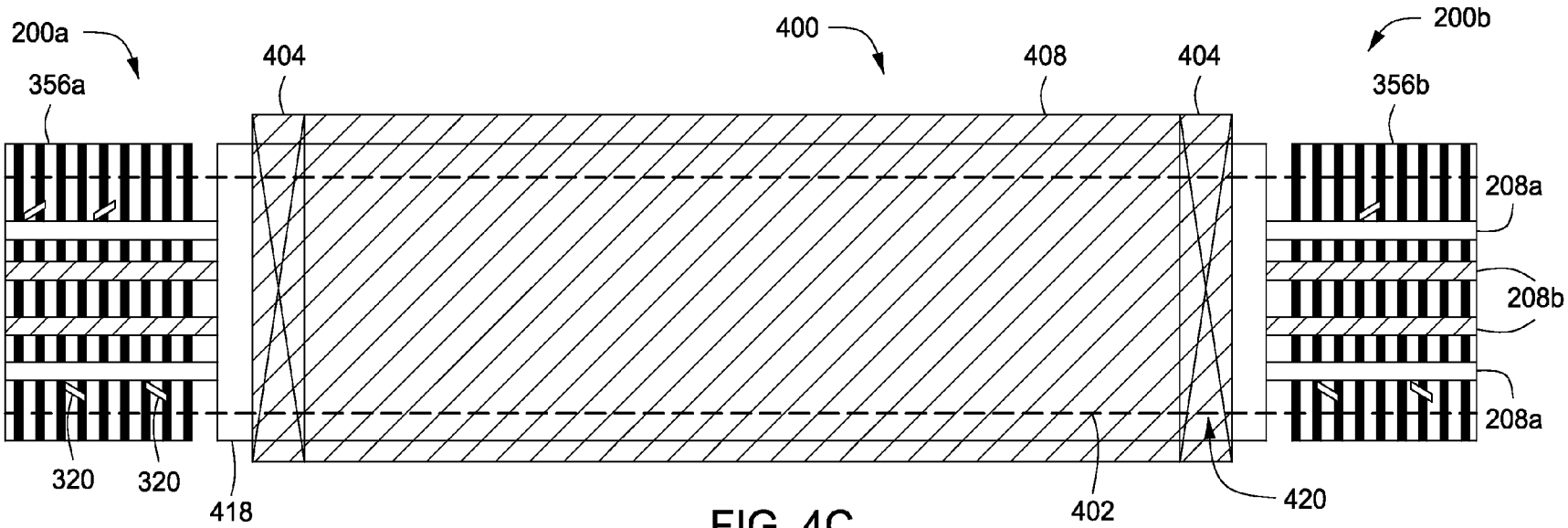
Figure 4D:
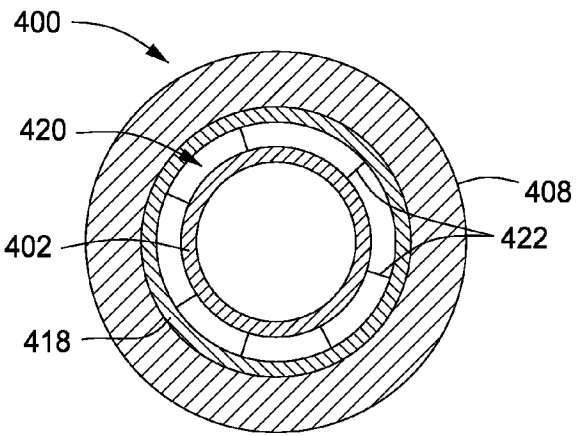

In addition, the packer assembly 400 includes a neck section 406 and notched section 410. The neck section 406 and notched section 410 may be made of steel or steel alloys, with each section configured to be a specific length 414, which may be similar to the length 314 discussed above. The neck section 406 and notched section 410 have specific internal and outer diameters. The neck section 406 may have external threads 408 while the notched section 410 may have internal threads 412. These threads 408 and 412 may be utilized to form a seal between the packer assembly 400 and a sand control device 200 or another pipe segment, which is shown in FIGS. 4B through 4D.

It should also be noted that the coupling mechanism for the packer assemblies 300, 400 and the sand control devices 200 may include sealing mechanisms. The sealing mechanism prevents leaking of the slurry that is in the alternate flowpath formed by the shunt tubes. Examples of such sealing mechanisms as described in U.S. Pat. No. 6,464,261; Intl. Patent Application No. WO2004/094769; Intl. Patent Application No. WO2005/031105; U.S. Patent Application Publ. No. 2004/0140089; U.S. Patent Application Publ. No. 2005/0028977; U.S. Patent Application Publ. No. 2005/0061501; and U.S. Patent Application Publ. No. 2005/0082060.

As with packer assembly 300, the packer assembly 400 may employ either internal shunt tubes or external shunt tubes. A configuration of the packer assembly 400 having internal shunt tubes 352 is shown in FIG. 4B, while a configuration of the packer assembly 400 having external shunt tubes 208*a*, 208*b* is shown in FIG. 4C.

FIG. 4B is a side view of the packer assembly 400 of FIG. 4A. In this view, the packer assembly 400 is connected at opposing ends to sand control devices 350*a*, 350*b*. The shunt tubes 352 preferably include a valve 358 to prevent fluids from an isolated interval from flowing through the shunt tubes 352 to another interval.

FIG. 4C is another side view of the packer assembly 400 of FIG. 4A. In this view, the packer assembly 400 is connected at opposing ends to sand control devices 200*a*, 200*b*. The shunt tubes 208*a*, 208*b* on the packer assembly 400 are seen connected to the sand screens 356*a*, 356*b* on the sand control devices 200*a*, 200*b*. The shunt tubes 208*a*, 208*b* preferably include a valve 320 to prevent fluids from an isolated interval from flowing through the shunt tubes 200*a*, 200*b* to another interval. The shunt tubes 208*a*, 208*b* are external to the filter mediums or sand screens 356*a* and 356*b*.

In FIGS. 4B and 4C, the neck section 406 and notched section 410 of the packer assembly 400 are coupled with sections or joints of the sand control devices 350*a*, 350*b* or 200*a*, 200*b*. Individual joints may be coupled together by engaging the threads 408 and 412 to form a threaded connection. Once connected, the manifold 420 provides unrestricted fluid flow paths between the shunt tubes 208 and 352 in the sand control devices as coupled to the packer assembly 400. The manifold 420 is configured to pass through the mechanically set packer elements 404 and the swellable packer element 408, and is a substantially unrestricted space. Alignment in this configuration is not necessary as fluids are commingled, which may include various shapes.

The sand control devices 350*a*, 350*b* or 200*a*, 200*b* are connected to the packer assembly 400 with a manifold connection. Flow from the shunt tubes in the sand control device 350*a*, 350*b* or 200*a*, 200*b* enters a sealed area above the connection where flow is diverted into the packer manifold 420. A cross-sectional view of the various components of the packer assembly 400 is shown in FIG. 4D. FIG. 4D is a taken along the line 4D-4D of FIG. 4B.

Figure 5A:
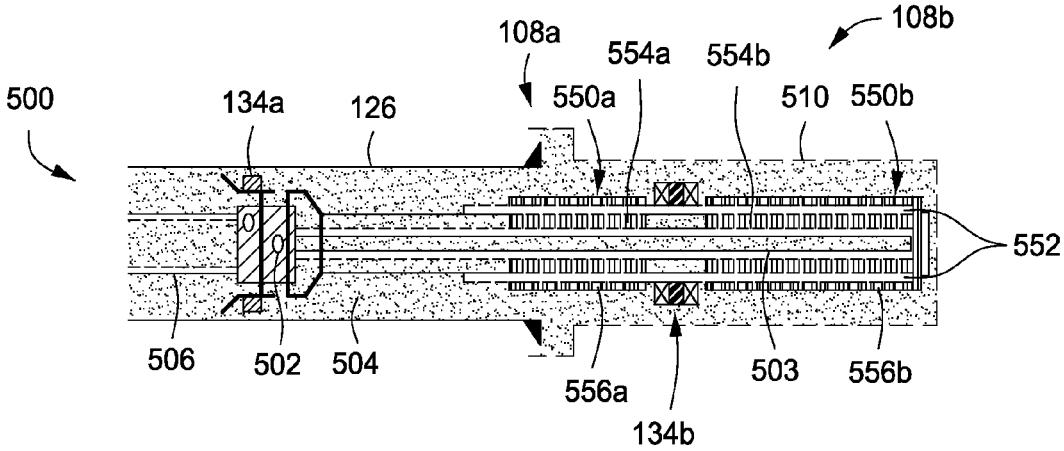
FIGS. 5A through 5N present stages of a gravel packing procedure using one of the packer assemblies of the present invention, in one embodiment, and using alternative flowpath channels through the packer elements of the packer assembly and through the sand control devices.
Figure 5B:
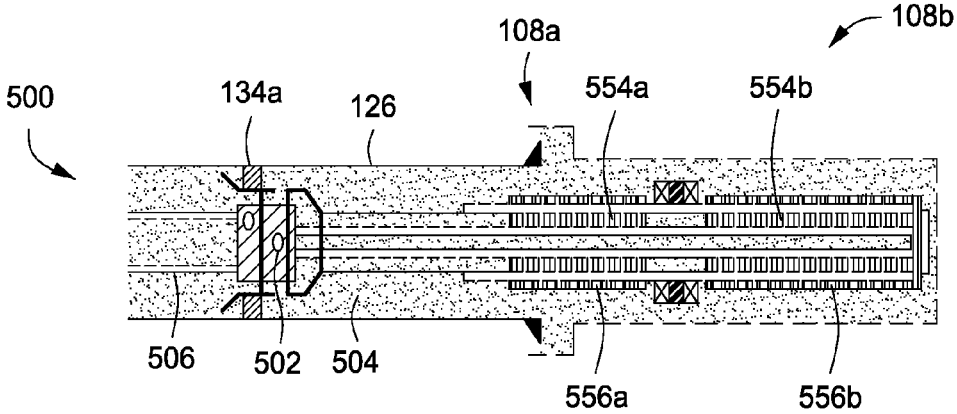
FIG. 5O shows a packer assembly and gravel pack having been set in an open hole wellbore following completion of the gravel packing procedure from FIGS. 5A through 5N.
Figure 5C:
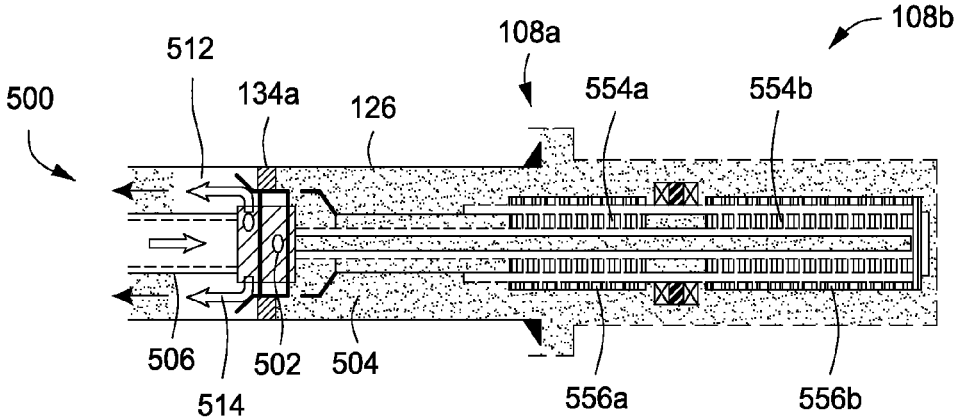
Figure 5D:
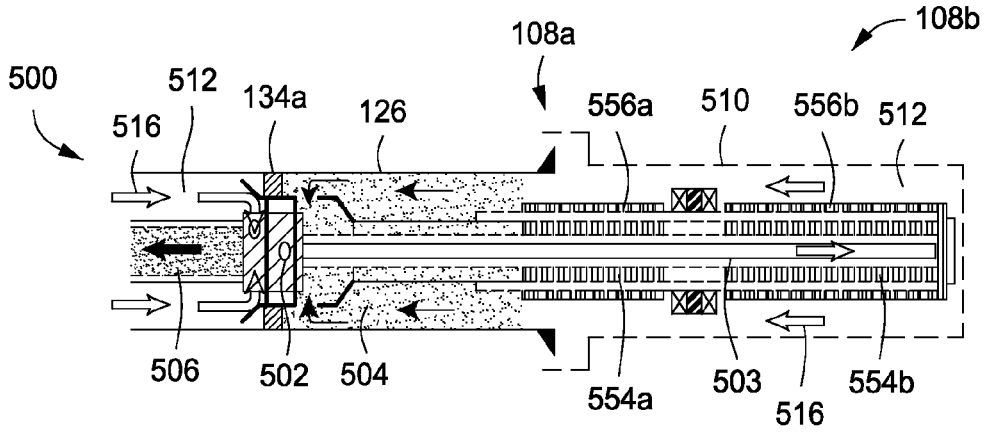
Figure 5E:
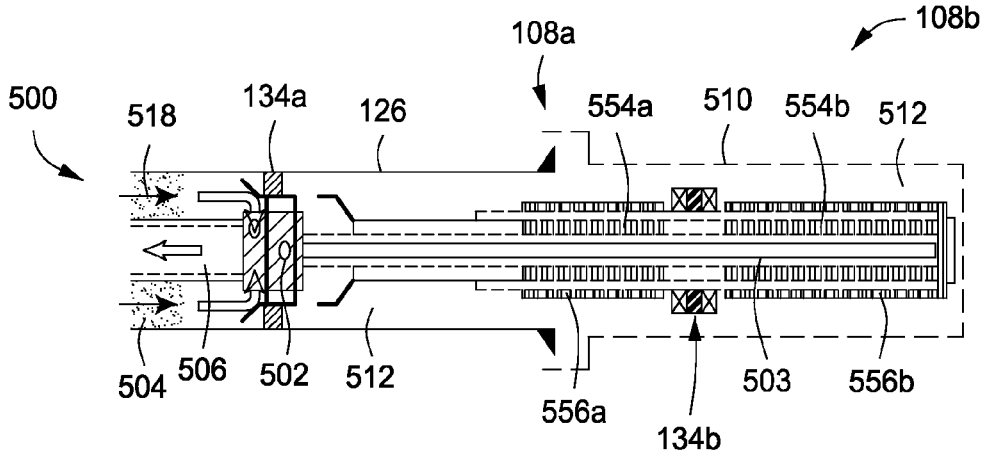
Figure 5F:
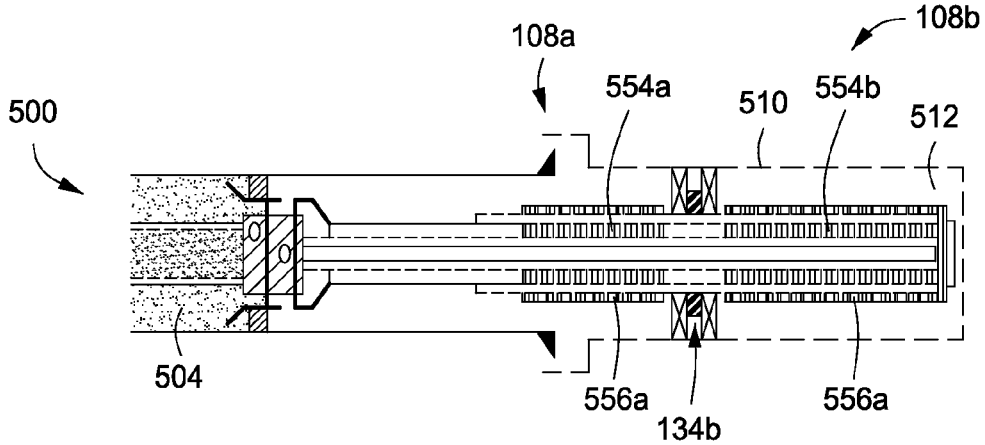
Figure 5G:
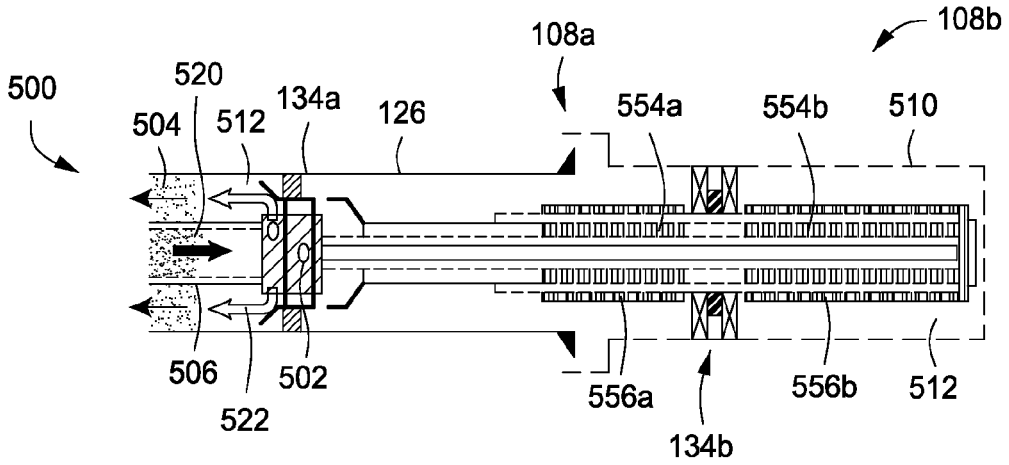
Figure 5H:
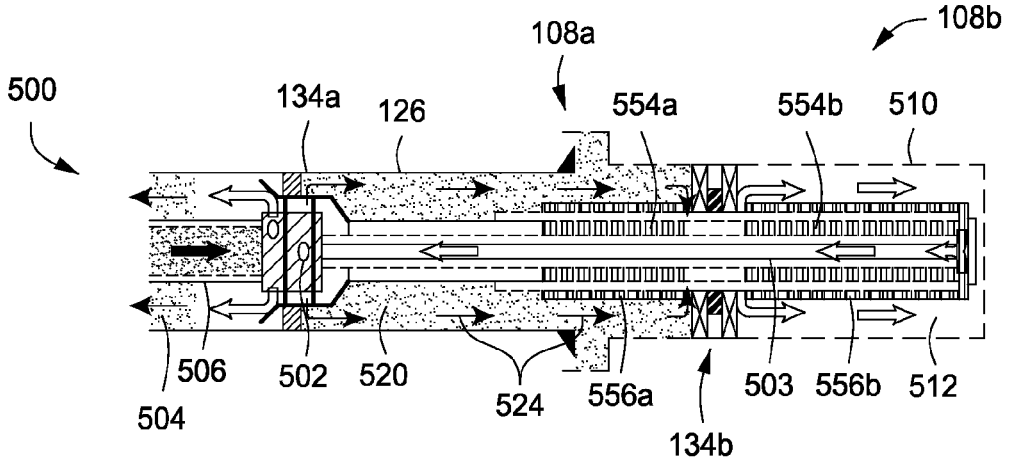
Figure 5I:
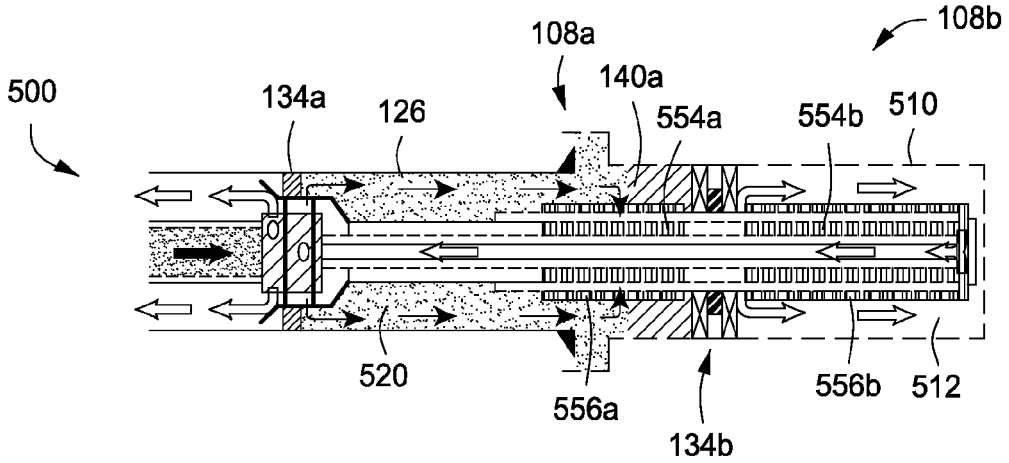
Figure 5J:
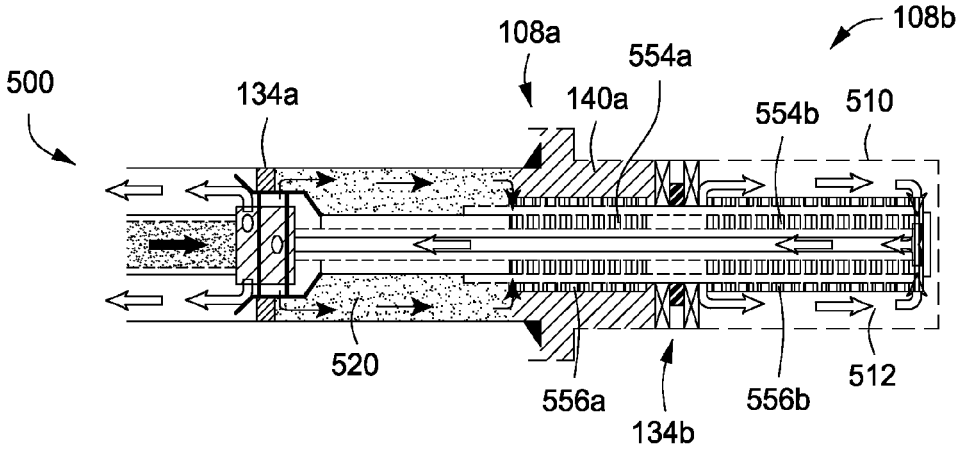
Figure 5K:
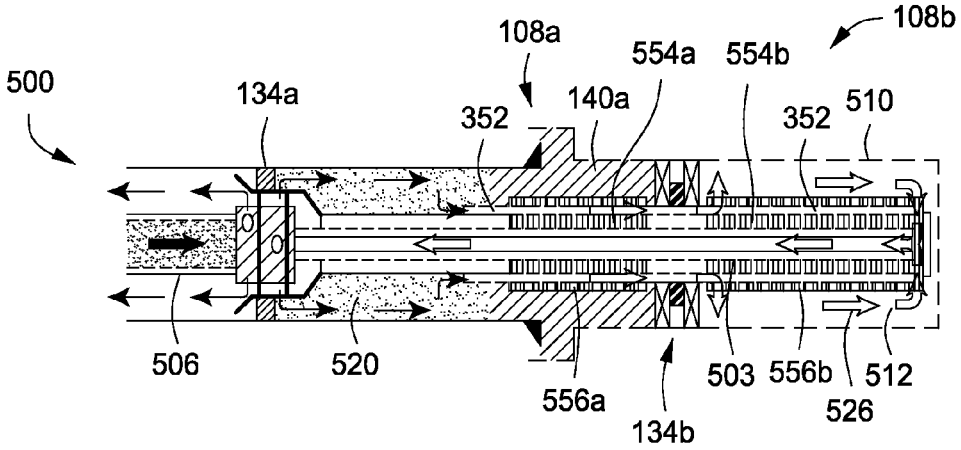
Figure 5L:
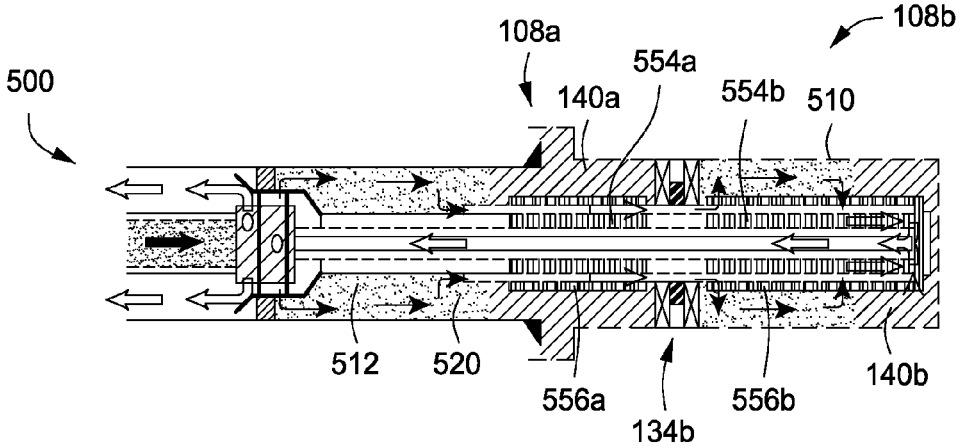
Figure 5M:
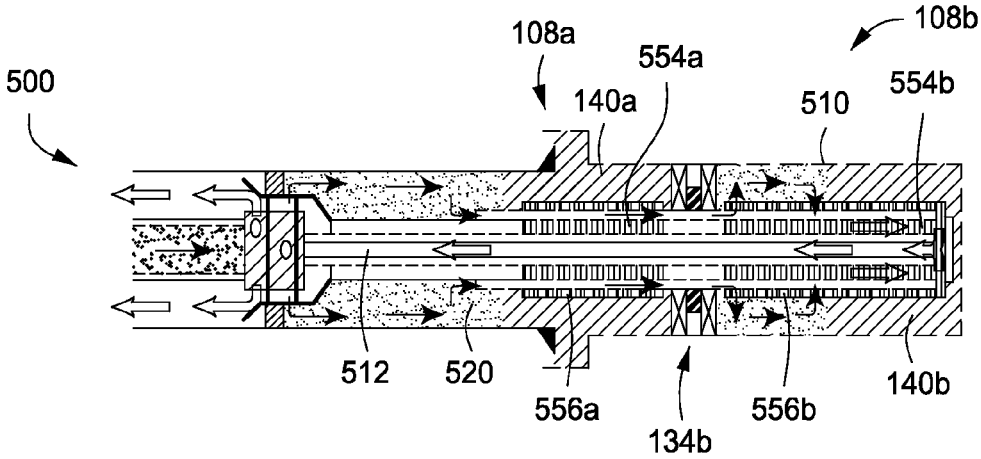
Figure 5N:
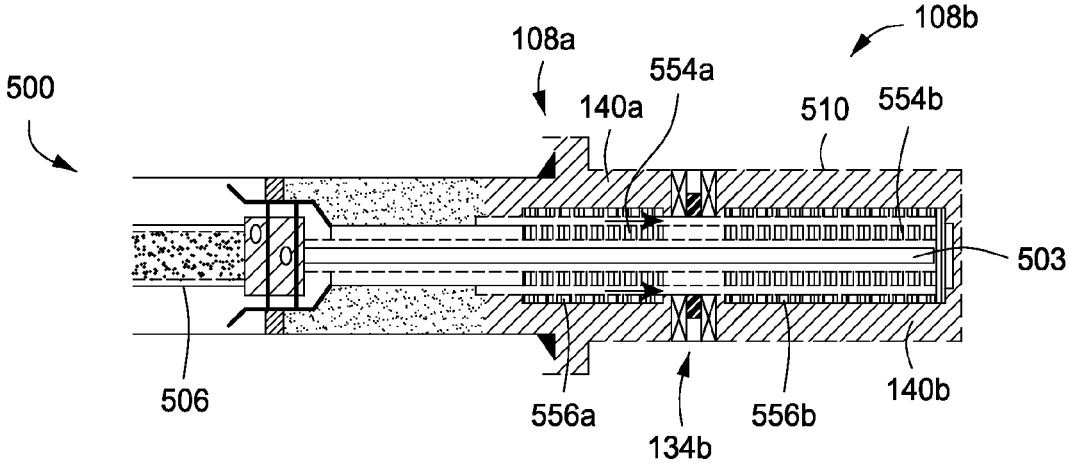

FIGS. 5A through 5N present stages of a gravel packing procedure, in one embodiment, using a packer assembly having alternative flowpath channels through the packer elements of the packer assembly and through connected sand control devices. Either of packer assembly 300 or packer assembly 400 may be used. FIGS. 5A through 5N provide illustrative embodiments of the installation process for the packer assemblies, the sand control devices, and the gravel pack in accordance with certain aspects of the present inventions. These embodiments involve an installation process that runs sand control devices and a packer assembly 300 or 400, in a conditioned drilling mud. The conditioned drilling mud may be a non-aqueous fluid (NAF) such as a solids-laden oil-based fluid, along with a solids-laden water-based fluid. This process, which is a two-fluid process, may include techniques similar to the process discussed in International Patent Application No. WO 2004/079145, which is hereby incorporated by reference. However, it should be noted that this example is simply for illustrative purposes, as other suitable processes and equipment may also be utilized.

In FIG. 5A, sand control devices 550*a* and 550*b* and packer assembly 134*b* are run into a wellbore 500. The sand control devices 550*a* and 550*b* are comprised of base pipes 554*a* and 554*b* and sand screens 556*a* and 556*b*. The sand control devices 550*a* and 550*b* also include alternate flow paths such as internal shunt tubes 352 from FIG. 3C. The illustrative shunt tubes 352 are preferably disposed between the base pipes 554*a*, 554*b* and the sand screens 556*a*, 556*b* in the annular region shown at 552.

In the arrangement of FIG. 5A, the packer 134*b* is installed between production intervals 108*a* and 108*b*. The packer 134*b* may be in accordance with packer 210' of FIG. 2. In addition, a crossover tool 502 with an elongated washpipe 503 is lowered in the wellbore 500 on a drill pipe 506. The washpipe 503 is an elongated tubular member that extends into the sand screens 556*a* and 556*b*. The washpipe 503 aids in the circulation of the gravel slurry during a gravel packing operation, and is subsequently removed.

A separate packer 134*a* is connected to the crossover tool 502. The crossover tool 502 and the packer 134*a* are temporarily positioned within a string of production casing 126. Together, the crossover tool 502, the packer 134*a* and the elongated washpipe 503 are run to the bottom of the wellbore 500. The packer 134*a* is then set as shown in FIG. 5B.

Returning to FIG. 5A, the conditioned NAF (or other drilling mud) 504 is placed in the wellbore 500. Preferably, the drilling mud 504 is deposited into the wellbore 500 and delivered to the open-hole portion before the drill string 506 and attached sand screens 550*a*, 550*b* and washpipe 503 are run into the wellbore 500. The drilling mud 504 may be conditioned over mesh shakers (not shown) before being placed within the wellbore 500 to reduce any potential plugging of the sand control devices 550*a* and 550*b*.

In FIG. 5B, the packer 134*a* is set in the production casing string 126. This means that the packer 134*a* is actuated to extend an elastomeric element against the surrounding casing string 126. The packer 134*a* is set above the intervals 108*a* and 108*b*, which are to be gravel packed. The packer 134*a* seals the intervals 108*a* and 108*b* from the portions of the wellbore 500 above the packer 134*a*.

After the packer 134*a* is set, as shown in FIG. 5C, the crossover tool 502 is shifted into a reverse position. A carrier fluid 512 is pumped down the drill pipe 506 and placed into an annulus between the drill pipe 506 and the surrounding production casing 126 above the packer 134*a*. The carrier fluid 512 displaces the conditioned drilling fluid 504 above the packer 134*a*, which again may be an oil-based fluid such as the conditioned NAF. The carrier fluid 512 displaces the drilling fluid 504 in the direction indicated by arrows 514.

Next, in FIG. 5D, the crossover tool 502 is shifted back into a circulating position. This is the position used for circulating gravel pack slurry, and is sometimes referred to as the gravel pack position. The carrier fluid 512 is then pumped down the annulus between the drill pipe 506 and the production casing 126. This pushes the conditioned NAF 504 through the base pipe 554*a* and 554*b*, out the sand screens 556*a* and 556*b*, sweeping the open-hole annulus between the sand screens 556*a* and 556*b* and the surrounding wall 510 of the open hole portion of the wellbore 500, and through the crossover tool 502 back into the drill pipe 506. The flow path of the carrier fluid 512 is indicated by the arrows 516.

In FIGS. 5E through 5G, the production intervals 108*a*, 108*b* are prepared for gravel packing. In FIG. 5E, once the open-hole annulus between the sand screens 556*a*, 556*b* and the surrounding wall 510 has been swept with carrier fluid 512, the crossover tool 502 is shifted back to the reverse position. Conditioned drilling fluid 504 is pumped down the annulus between the drill pipe 506 and the production casing 126 to force the carrier fluid 512 out of the drill pipe 506, as shown by the arrows 518. These fluids may be removed from the drill pipe 506.

Next, the packer 134*b* is set, as shown in FIG. 5F. The packer 134*b*, which may be one of the packers 300 or 400, for example, may be utilized to isolate the annulus formed between the sand screens 556*a* and 556*b* and the surrounding wall 510 of the wellbore 500. While still in the reverse position, as shown in FIG. 5G, the carrier fluid 512 with gravel 520 may be placed within the drill pipe 506 and utilized to force the drilling fluid 504 up the annulus formed between the drill pipe 506 and production casing 126 above the packer 134*a*, as shown by the arrows 522.

In FIGS. 5H through 5J, the crossover tool 502 may be shifted into the circulating position to gravel pack the first subsurface interval 108*a*. In FIG. 5H, the carrier fluid 512 with gravel 520 begins to create a gravel pack within the production interval 108*a* above the packer 134*b* in the annulus between the sand screen 556*a* and the wall 510 of the open-hole wellbore 500. The fluid flows outside the sand screen 556*a* and returns through the washpipe 503 as indicated by the arrows 524. In FIG. 5I, a first gravel pack 140*a* begins to form above the packer 134*b*, around the sand screen 556*a*, and toward the packer 134*a*. In FIG. 8J, the gravel packing process continues to form the gravel pack 140*a* toward the packer 134*a* until the sand screen 556*a* is covered by the gravel pack 140*a*.

Once the gravel pack 140*a* is formed in the first interval 108*a* and the sand screens above the packer 134*b* are covered with gravel, the carrier fluid 512 with gravel 520 is forced through the shunt tubes 352 and the packer 134*b*. The carrier fluid 512 with gravel 520 begins to create a second gravel pack 140*b* in FIGS. 5K through 5N. In FIG. 5K, the carrier fluid 512 with gravel 520 begins to create the second gravel pack 140*b* within the production interval 108*b* below the packer 134*b* in the annulus between the sand screen 556*b* and the walls 510 of the wellbore 500. The fluid flows through the shunt tubes and packer 134*b*, outside the sand screen 556*b* and returns through the washpipe 503 as indicated by the arrows 526.

In FIG. 5L, the second gravel pack 140*b* begins to form below the packer 134*b* and around the sand screen 556*b*. In FIG. 5M, the gravel packing continues to grow the gravel pack 140*b* up toward the packer 134*b* until the sand screen 556*b* is covered by the gravel pack 140*b*. In FIG. 5N, the gravel packs 140*a* and 140*b* are formed and the surface treating pressure increases to indicate that the annular space between the sand screens 556*a* and 556*b* and the walls 510 of the wellbore are gravel packed.

Figure 5O:
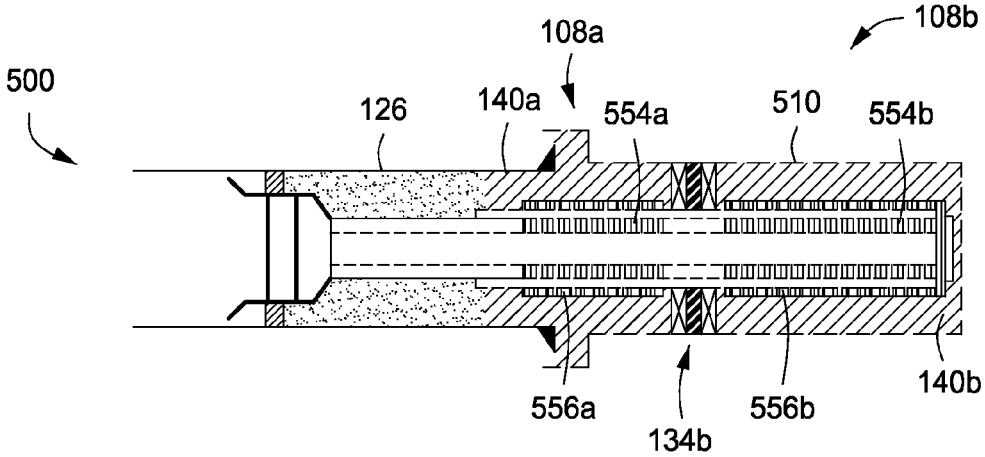

FIG. 5O shows the drill string 506 and the washpipe 503 from FIGS. 5A through 5N having been removed from the wellbore 500. The casing 126, the base pipes 554*a*, 554*b*, and the sand screens 556*a*, 556*b* remain in the wellbore 500 along the upper 108*a* and lower 108*b* production intervals. Packer 134*b* and the gravel packs 140*a*, 140*b* remain set in the open hole wellbore 500 following completion of the gravel packing procedure from FIGS. 5A through 5N. The wellbore 500 is now ready for production operations.

Figure 6A:
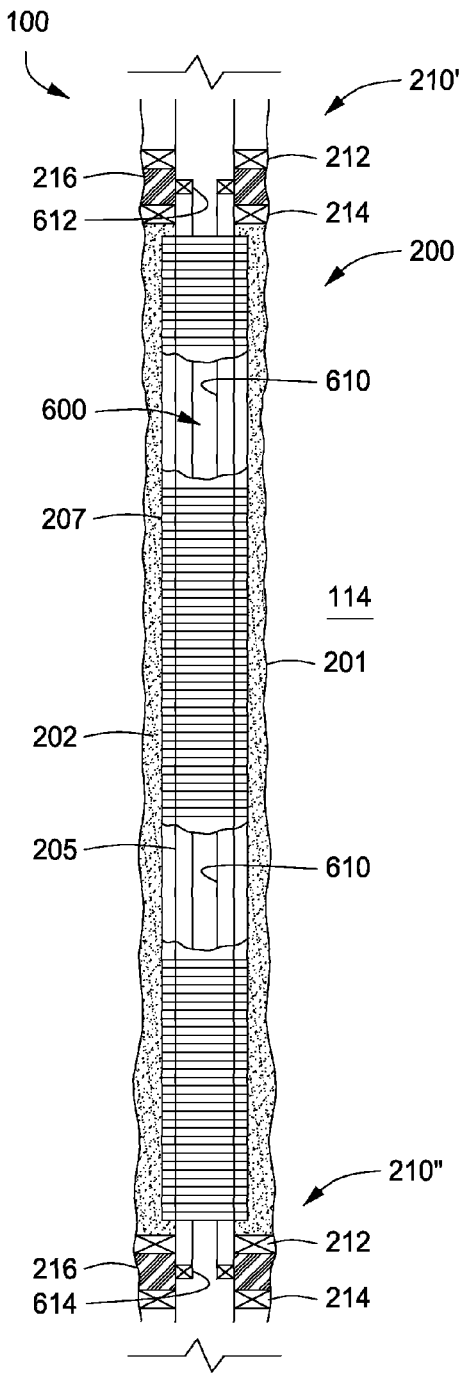
FIG. 6A is a cross-sectional view of a middle interval of the open-hole completion of FIG. 2. Here, a straddle packer has been placed within a sand control device across the middle interval to prevent the inflow of formation fluids.

FIG. 6A is a cut-away view of a wellbore 100. The wellbore 100 is intended to be the same wellbore as wellbore 100 of FIG. 2. In FIG. 6A, the wellbore 100 is shown intersecting through a subsurface interval 114. Interval 114 represents an intermediate interval. This means that there is also an upper interval 112 and a lower interval 116 (not shown in FIG. 6A).

The subsurface interval 114 may be a portion of a subsurface formation that once produced hydrocarbons in commercially viable quantities but has now suffered significant water or hydrocarbon gas encroachment. Alternatively, the subsurface interval 114 may be a formation that was originally a water zone or aquitard or is otherwise substantially saturated with aqueous fluid. In either instance, the operator has decided to seal off the influx of formation fluids from interval 114 into the wellbore 100.

In the wellbore 100, a base pipe 205 is seen extending through the intermediate interval 114. The base pipe 205 is part of the sand control device 200. The sand control device 200 also includes a mesh, a wire screen, or other radial filter medium 207. The base pipe 205 and surrounding filter medium 207 is preferably a series of joints that are ideally about 5 to 35 feet in length.

The wellbore 100 has an upper packer assembly 210' and a lower packer assembly 210". The upper packer assembly 210' is disposed near the interface of the upper interval 112 and the intermediate interval 114, while the lower packer assembly 210" is disposed near the interface of the intermediate interval 114 and the lower interval 116. The wellbore 200 is completed as an open hole completion. A gravel pack has been placed in the wellbore 200 to help guard against the inflow of granular particles into the wellbore 200. Gravel packing is indicated as spackles in the annulus 202 between the sand screen 207 and the surrounding wall 201 of the wellbore 200.

As noted, the operator desires to continue producing formation fluids from upper 112 and lower 116 intervals while sealing off intermediate interval 114. The upper 112 and lower 116 intervals are formed from sand or other rock matrix that is permeable to fluid flow. To accomplish this, a straddle packer 600 has been placed within the sand control device 200. The straddle packer 600 is placed substantially across the intermediate interval 114 to prevent the inflow of formation fluids from the intermediate interval 114.

The straddle packer 600 comprises a mandrel 610. The mandrel 610 is an elongated tubular body having an upper end adjacent the upper packer assembly 210', and a lower end adjacent the lower packer assembly 210". The straddle packer 600 also comprises a pair of annular packers. These represent an upper packer 612 adjacent the upper packer assembly 210', and a lower packer 614 adjacent the lower packer assembly 210". The novel combination of the upper packer assembly 210' with the upper packer 612, and the lower packer assembly 210" with the lower packer 614 allows the operator to successfully isolate a subsurface interval such as intermediate interval 114 in an open hole completion.

Figure 6B:
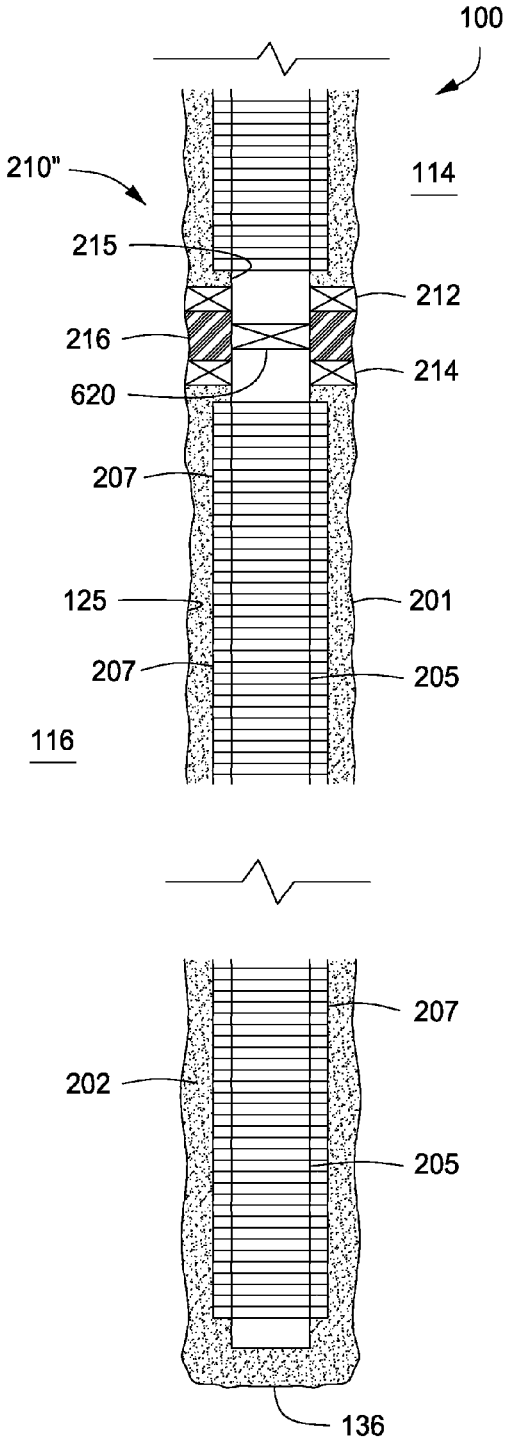
FIG. 6B is a cross-sectional view of middle and lower intervals of the open-hole completion of FIG. 2. Here, a plug has been placed within a packer assembly between the middle and lower intervals to prevent the flow of formation fluids up the wellbore from the lower interval.

Another technique for isolating an interval along an open hole formation is shown in FIG. 6B. FIG. 6B is a side view of the wellbore 100 of FIG. 2. A bottom portion of the intermediate interval 114 of the open-hole completion is shown. In addition, the lower interval 116 of the open-hole completion is shown. The lower interval 116 extends essentially to the bottom 136 of the wellbore 100 and is the lowermost zone of interest.

In this instance, the subsurface interval 116 may be a portion of a subsurface formation that once produced hydrocarbons in commercially viable quantities but has now suffered significant water or hydrocarbon gas encroachment. Alternatively, the subsurface interval 116 may be a formation that was originally a water zone or aquitard or is otherwise substantially saturated with aqueous fluid. In either instance, the operator has decided to seal off the influx of formation fluids from the lower interval 116 into the wellbore 100.

To accomplish this, a plug 620 has been placed within the wellbore 100. Specifically, the plug 620 has been set in the mandrel 215 supporting the lower packer assembly 210". Of the two packer assemblies 210', 210", only the lower packer assembly 210" is seen. By positioning the plug 620 in the lower packer assembly 210", the plug 620 is able to prevent the flow of formation fluids into the wellbore 200 from the lower interval 116.

It is noted that in connection with the arrangement of FIG. 6B, the intermediate interval 114 may comprise a shale or other rock matrix that is substantially impermeable to fluid flow. In this situation, the plug 620 need not be placed adjacent the lower packer assembly 210"; instead, the plug 620 may be placed anywhere above the lower interval 116 and along the intermediate interval 114. Further, the lower packer assembly 210" itself need not be positioned at the top of the lower interval 116; instead, the lower packer assembly 210" may also be placed anywhere along the intermediate interval 114. The functionality of the packer assemblies 210 described herein permit their use in a variety of manners depending on the properties and configuration of the formation and the wellbore. The movement of the lower packer assembly 210" to any position along the intermediate interval 114 is one example. In other implementations, the upper packer assembly 210' may be moved away from an interval interface to be in the middle of a formation, depending on the manner in which the well is to be operated and the circumstances presented by the formation.

Figure 7:
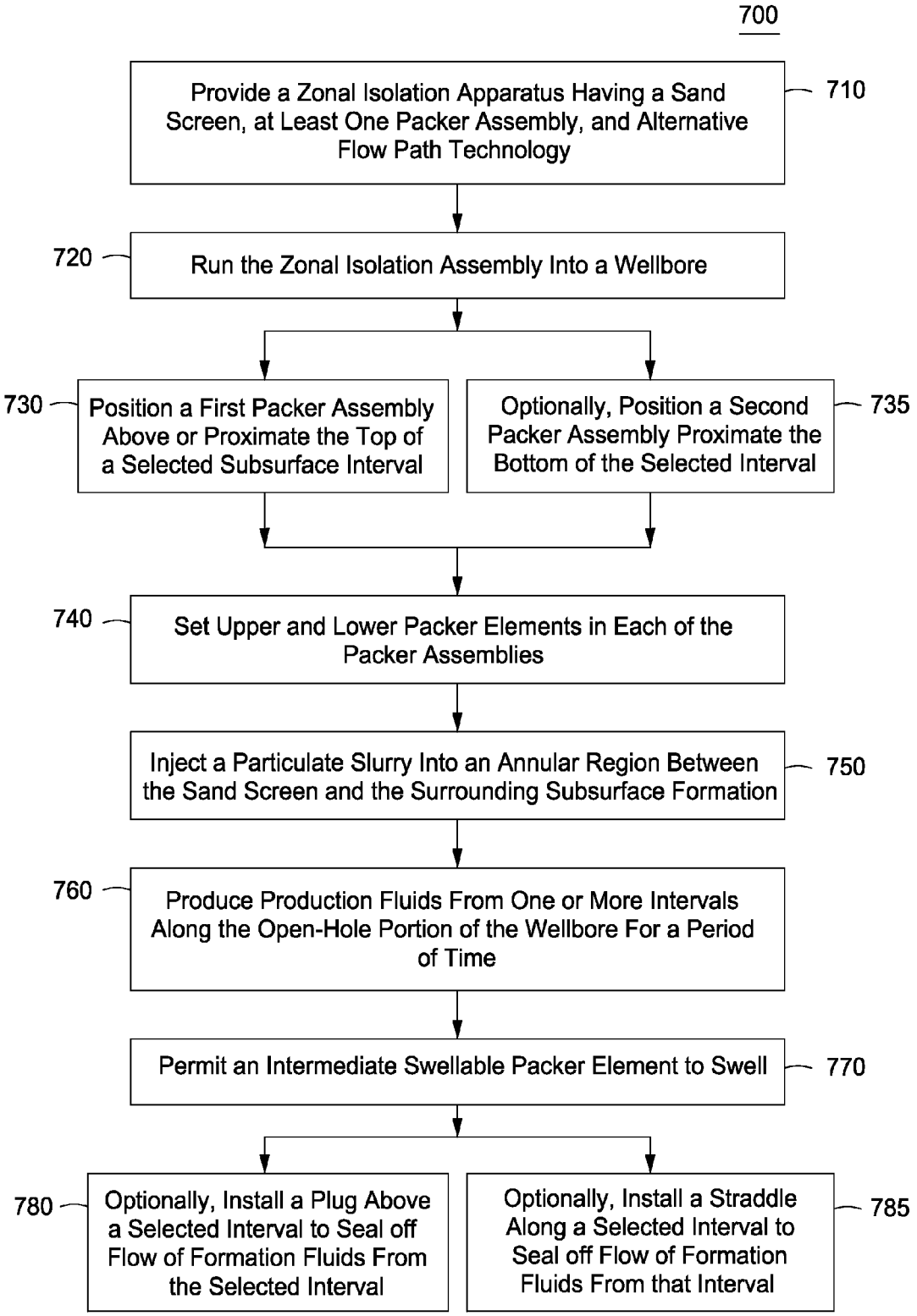
FIG. 7 is a flowchart showing steps that may be performed in connection with a method for completing an open-hole wellbore.

A method 700 for completing an open-hole wellbore is also provided herein. The method 700 is presented in FIG. 7. FIG. 7 provides a flowchart presenting steps for a method 700 of completing an open-hole wellbore, in various embodiments.

The method 700 includes providing a zonal isolation apparatus. This is shown at Box 710 of FIG. 7. The zonal isolation apparatus is preferably in accordance with the components described above in connection with FIG. 2. In this respect, the zonal isolation apparatus may include a base pipe, a screen (or other filter medium), at least one packer assembly having at least two mechanically set packer elements and an intermediate elongated swellable packer element, and alternative flow channels. The sand control devices may be referred to as sand screens.

The method 700 also includes running the zonal isolation apparatus into the wellbore. The step of running the zonal isolation apparatus into the wellbore is shown at Box 720. The zonal isolation apparatus is run into a lower portion of the wellbore, which is preferably completed as an open-hole.

The method 700 also includes positioning the zonal isolation apparatus in the wellbore. This is shown in FIG. 7 at Box 730. The step of positioning the zonal isolation apparatus is preferably done by hanging the zonal isolation apparatus from a lower portion of a string of production casing. The apparatus is positioned such that the base pipe and sand screen are adjacent one or more selected intervals along the open-hole portion of the wellbore. Further, a first of the at least one packer assembly is positioned above or proximate the top of a selected subsurface interval.

In one embodiment, the open-hole wellbore traverses through three separate intervals. These include an upper interval from which hydrocarbons are produced, and a lower interval from which hydrocarbons are no longer being produced in economically viable volumes. Such intervals may be formed of sand or other permeable rock matrix. The intervals also include an intermediate interval from which hydrocarbons are not produced. The formation in the intermediate interval may be formed of shale or other substantially impermeable material. The operator may choose to position the first of the at least one packer assembly near the top of the lower interval or anywhere along the non-permeable intermediate interval.

The method 700 next includes setting the mechanically set packer elements in each of the at least one packer assembly. This is provided in Box 740. Mechanically setting the upper and lower packer elements means that an elastomeric (or other) sealing member engages the surrounding wellbore wall. The packer elements isolate an annular region formed between the sand screens and the surrounding subsurface formation above and below the packer assemblies.

The method 700 also includes injecting a particulate slurry into the annular region. This is demonstrated in Box 750. The particulate slurry is made up of a carrier fluid and sand (and/or other) particles. One or more alternate flow channels allow the particulate slurry to bypass the mechanically set packer elements and the intermediate swellable packer element. In this way, the open-hole portion of the wellbore is gravel-packed above and below (but not between) the mechanically set packer elements.

The method 700 further includes producing production fluids from intervals along the open-hole portion of the wellbore. This is provided at Box 760. Production takes place for a period of time. Over the period of time, the upper packer element, the lower packer element, or both, may fail. This permits the inflow of fluids into an intermediate portion of the packer along the swellable packer element. This will cause the swellable packer element to swell, thereby once again sealing the selected interval. This is shown at Box 770 of FIG. 7.

It is acknowledged that it would be preferable for the swellable packer element to be exposed to fluids prior to gravel packing. In this way the swellable packer element could swell and establish a good annular seal with the surrounding wall of the open-hole portion of the wellbore before a packer element failure. However, such a technique presents two problems: (1) alternate flowpath channels are required through the packer assemblies, e.g., assemblies 210' and 210", to pack the lower interval(s), and (2) the time value of the drilling rig precludes waiting days or weeks for the swelling element to effectively seal. Therefore, such a procedure is not preferred.

In many cases, fluids native to a subsurface interval adjacent the swellable packer element may already exist. These fluids will cause the swellable packer element to swell and to engage the surrounding wellbore wall without failure of either of the mechanically set packer elements. Thus, the step 770 of allowing the swellable packer element to swell may occur naturally. This step 770 may also take place by the operator affirmatively injecting an actuating chemical into the base pipe.

In one embodiment of the method 700, flow from a selected interval may be sealed from flowing into the wellbore. For example, a plug may be installed in the base pipe of the sand screen above or near the top of a selected subsurface interval. This is shown at Box 780. Such a plug may be used below the lowest packer assembly, such as the second packer assembly from step 735.

In another example, a straddle packer is placed along the base pipe along a selected subsurface interval to be sealed. This is shown at Box 785. Such a straddle may involve placement of sealing elements adjacent upper and lower packer assemblies (such as packer assemblies 210', 210" of FIG. 2 or FIG. 6A) along a mandrel.

While it will be apparent that the inventions herein described are well calculated to achieve the benefits and advantages set forth above, it will be appreciated that the inventions are susceptible to modification, variation and change without departing from the spirit thereof. Improved methods for completing an open-hole wellbore are provided so as to seal off one or more selected subsurface intervals. An improved zonal isolation apparatus is also provided. The inventions permit an operator to produce fluids from or to inject fluids into a selected subsurface interval.

What is claimed is:

1. A gravel pack zonal isolation apparatus, comprising:
a sand control device having an elongated base pipe extending from an upper end to a lower end; and
at least one packer assembly, each of the at least one packer assembly comprising:
an upper mechanically set packer having a sealing element,
a lower mechanically set packer having a sealing element,
a swellable packer element between the upper mechanically set packer and the lower mechanically set packer that swells over time in the presence of a fluid,
alternate flow channels along the base pipe to divert gravel pack slurry around the upper mechanically set packer, the swellable packer element, and the lower mechanically set packer, and
a manifold in fluid communication with the alternate flow channels, whereby the manifold commingles and redistributes flow among the alternate flow channels.

2. The apparatus of claim 1, wherein:
the sand control device further comprises a filter medium radially surrounding the base pipe along a substantial portion of the base pipe so as to form a sand screen; and
the swellable packer element is at least partially fabricated from an elastomeric material.

3. The apparatus of claim 2, wherein the filter medium for the sand screen is a mesh or a wire screen.

4. The apparatus of claim 2, wherein the swellable elastomeric packer element comprises a material that swells (i) in the presence of an aqueous liquid, (ii) in the presence of a hydrocarbon liquid, or (iii) combinations thereof.

5. The apparatus of claim 2, wherein the swellable elastomeric packer element comprises a material that swells in the presence of an actuating chemical.

6. The apparatus of claim 1, wherein:
the elongated base pipe comprises multiple joints of pipe connected end-to-end; and
at least one of the at least one packer assembly is placed along the joints of pipe proximate the upper end of the sand control device.

7. The apparatus of claim 1, wherein:
the elongated base pipe comprises multiple joints of pipe connected end-to-end; and
the gravel pack zonal isolation apparatus comprises an upper packer assembly and a lower packer assembly placed along the joints of pipe.

8. The apparatus of claim 7, wherein the upper packer assembly and the lower packer assembly are spaced apart along the joints of pipe so as to straddle a selected subsurface interval within a wellbore.

9. The apparatus of claim 1, wherein the element for the first mechanically set packer and the element for the second mechanically set packer is each about 6 inches to 24 inches in length.

10. The apparatus of claim 9, wherein the elements for the first and second mechanically set packer elements are elastomeric cup-type elements.

11. The apparatus of claim 2, wherein the swellable elastomeric packer element is about 3 feet to about 40 feet in length.

12. A method for completing a wellbore, the wellbore having a lower end defining an open-hole portion, the method comprising:
running a gravel pack zonal isolation apparatus into the wellbore, the zonal isolation apparatus comprising:
a sand control device having an elongated base pipe; and
at least one packer assembly, each of the at least one packer assembly comprising:
a first mechanically set packer having an upper sealing element,
a second mechanically set packer having a lower sealing element,
a swellable packer element between the upper sealing element and the lower sealing element that swells over time in the presence of a fluid,
one or more alternate flow channels between the base pipe and the sealing elements to divert gravel pack slurry around the first mechanically set packer element, the swellable packer element, and the second mechanically set packer element, and
a manifold in fluid communication with the alternate flow channels, whereby the manifold commingles and redistributes flow among the alternate flow channels;
positioning the zonal isolation apparatus in the open-hole portion of the wellbore such that a first of the at least one packer assembly is above or proximate the top of a selected subsurface interval;
setting the upper sealing element and the lower sealing element in each of the at least one packer assembly; and
injecting a gravel slurry into an annular region formed between the sand control device and the surrounding open-hole portion of the wellbore, providing that the gravel slurry travels through the one or more alternate flow channels and the manifold to allow the gravel slurry to bypass the first and second mechanically set packers and the intermediate swellable packer element in each of the at least one packer assembly so that the open-hole portion of the wellbore is gravel-packed above and below, but not between, the respective first and second mechanically set packers.

13. The method of claim 12 wherein:
the sand control device further comprises a filter medium radially surrounding the base pipe along a substantial portion of the base pipe so as to form a sand screen; and
the swellable packer element is at least partially fabricated from an elastomeric material.

14. The method of claim 13, wherein the filter medium for the sand screen is a mesh or a wire screen.

15. The method of claim 12, further comprising:
permitting fluids to contact the swellable packer element in at least one of the at least one packer assembly; and wherein the swellable packer element comprises a material that swells (i) in the presence of an aqueous liquid, (ii) in the presence of a hydrocarbon liquid, or (iii) combinations thereof.

16. The method of claim 15, wherein:

the wellbore is completed for fluid production;

the open-hole portion of the wellbore passes through the selected subsurface interval and at least one more subsurface interval; and the method further comprises producing production fluids from at least one of the subsurface intervals along the open-hole portion of the wellbore for a period of time.

17. The method of claim 16, wherein:

the selected subsurface interval is substantially saturated with an aqueous or gaseous fluid;

the first of the at least one packer assembly is positioned proximate the top of the interval substantially saturated with the aqueous or gaseous fluid; and a second of the at least one packer assembly is set proximate a lower boundary of the interval substantially saturated with the aqueous or gaseous fluid.

18. The method of claim 17, wherein:

the at least one more subsurface interval comprises a lower interval below the interval substantially saturated with an aqueous or gaseous fluid; and producing production fluids comprises producing production fluids from the lower interval.

19. The method of claim 18, further comprising:

running a tubular string into the wellbore and into the base pipe, the tubular string having a straddle packer at a lower end;

setting the straddle packer across the interval substantially saturated with the aqueous or gaseous fluid so as to seal off formation fluids from entering the wellbore from said interval; and continuing to produce production fluids from the lower interval.

20. The method of claim 18, wherein:

the at least one more subsurface interval further comprises an upper interval above the interval substantially saturated with an aqueous or gaseous fluid, and producing production fluids further comprises producing production fluids from the upper interval.

21. The method of claim 20, further comprising:

running a tubular string into the wellbore and into the base pipe, the tubular string having a straddle packer at a lower end;

setting the straddle packer across the interval substantially saturated with the aqueous or gaseous fluid so as to seal off formation fluids there from; and continuing to produce production fluids from the upper and lower intervals.

22. The method of claim 21, wherein:

an upper end of the straddle packer is set adjacent the first packer assembly; and a lower end of the straddle packer is set adjacent the second packer assembly.

23. The method of claim 16, wherein:

the at least one more subsurface interval comprises a lower interval;

the selected interval is an upper interval above the lower interval such that a first of the at least one packer assembly is proximate the top of the upper interval;

a second of the at least one packer assembly is set proximate a lower boundary of the upper interval;

producing production fluids comprises producing production fluids from the upper selected interval and from the lower interval until the upper interval produces an unacceptable percentage of water or hydrocarbon gas; and the method further comprises:

running a tubular string into the wellbore and into the base pipe, the tubular string having a straddle packer at a lower end, setting the straddle packer across the upper interval so as to seal off the production of formation fluids from the upper interval up the wellbore, and continuing to produce production fluids from the lower selected interval.

24. The method of claim 23, wherein:

an upper end of the straddle packer is set adjacent the first packer assembly; and a lower end of the straddle packer is set adjacent the second packer assembly.

25. The method of claim 16, wherein:

the at least one more subsurface interval comprises an upper interval;

the selected interval is a lower interval below the upper interval such that a first of the at least one packer assembly is above or proximate the top of the lower interval;

producing production fluids comprises producing production fluids from the upper interval and from the lower interval until the lower interval no longer produces economically viable volumes of hydrocarbons; and the method further comprises:

running a working string into the wellbore and into the base pipe, the working string having a plug at a lower end of the working string, setting the plug within the base pipe so as to seal off the production of formation fluids from the lower interval up the wellbore to the upper interval, and continuing to produce production fluids from the upper interval.

26. The method of claim 25, wherein the plug is set adjacent the first of the at least one packer assembly.

27. The method of claim 25, wherein the elongated base pipe comprises multiple joints of pipe connected end-to-end.

28. The method of claim 25, wherein:

the at least one more subsurface interval further comprises an intermediate interval between the upper interval and the selected lower interval, with the intermediate interval being made up of a rock matrix that is substantially impermeable to fluid flow; and (i) the first of the at least one packer assembly is positioned above the lower interval and along the intermediate interval, (ii) the plug is set above the lower interval and along the intermediate interval, or (iii) both.

29. The method of claim 16, wherein:

the selected subsurface interval is a lower interval that produces hydrocarbons;

the at least one more subsurface interval comprises (i) an upper interval above the selected lower interval, and (ii) an intermediate interval between the upper interval and the selected lower interval that is made up of a rock matrix that is substantially impermeable to fluid flow.

30. The method of claim 29, wherein:

the first of the at least one packer assembly is positioned proximate a bottom of the upper interval;

a second of the at least one packer assembly is positioned proximate a top of the upper interval; and the method further comprises:

running a tubular string into the wellbore and into the base pipe, the tubular string having a straddle packer at a lower end, setting the straddle packer across the upper interval so as to seal off the production of formation fluids from the upper interval into the wellbore, and continuing to produce production fluids from the selected lower interval.

31. The method of claim 28, wherein:

the first of the at least one packer assembly is positioned (i) along the intermediate interval, or (ii) proximate the top of the selected lower interval;

the method further comprises:

running a working string into the wellbore and into the base pipe, the working string having a plug at a lower end of the working string, and setting the plug within the base pipe so as to seal off the flow of formation fluids from the lower interval up the wellbore to the upper interval; and continuing to produce production fluids from the upper interval.

32. The method of claim 16, further comprising:

injecting fluids into the at least one more subsurface interval.

* * * * *